US012268933B2

(12) United States Patent
Huch

(10) Patent No.: US 12,268,933 B2
(45) Date of Patent: Apr. 8, 2025

(54) TRAINING SYSTEM

(71) Applicant: Paul David Huch, Rochester, MI (US)

(72) Inventor: Paul David Huch, Rochester, MI (US)

( * ) Notice: Subject to any disclaimer, the term of this patent is extended or adjusted under 35 U.S.C. 154(b) by 63 days.

(21) Appl. No.: 17/362,328

(22) Filed: Jun. 29, 2021

(65) Prior Publication Data

US 2021/0402256 A1 Dec. 30, 2021

Related U.S. Application Data

(60) Provisional application No. 63/046,450, filed on Jun. 30, 2020.

(51) Int. Cl.

| | |
|---|---|
| ***A63B 24/00*** | (2006.01) |
| ***A63B 21/00*** | (2006.01) |
| ***A63B 21/062*** | (2006.01) |
| ***A63B 69/12*** | (2006.01) |
| ***A63B 71/06*** | (2006.01) |

(52) U.S. Cl.

CPC ..... *A63B 24/0062* (2013.01); *A63B 21/0628* (2015.10); *A63B 21/154* (2013.01); *A63B 69/12* (2013.01); *A63B 71/0622* (2013.01); *A63B 2071/0625* (2013.01); *A63B 2214/00* (2020.08); *A63B 2220/62* (2013.01); *A63B 2220/833* (2013.01); *A63B 2225/20* (2013.01); *A63B 2244/20* (2013.01)

(58) Field of Classification Search

CPC ..... A63B 24/0062; A63B 21/0628; A63B 21/154; A63B 69/12; A63B 71/0622; A63B 2214/00; A63B 2071/0625; A63B 2220/62; A63B 2220/833; A63B 2225/20; A63B 2244/20

See application file for complete search history.

(56) References Cited

U.S. PATENT DOCUMENTS

| | | | | |
|---|---|---|---|---|
| 3,861,675 A * | 1/1975 | Hopper | A63B 69/12 482/55 |
| 5,271,416 A * | 12/1993 | Lepley | A63B 21/22 600/595 |
| 5,349,569 A | 9/1994 | Tanaka | |
| 5,391,080 A | 2/1995 | Bernacki | |
| 5,713,792 A | 2/1998 | Ohzono | |
| 5,813,945 A | 9/1998 | Bernacki | |
| 5,938,565 A | 8/1999 | Bernacki | |

(Continued)

FOREIGN PATENT DOCUMENTS

| | | | |
|---|---|---|---|
| GB | 2483117 A * | 2/2012 | A63B 21/0628 |
| NL | 1024895 C2 * | 5/2005 | A63B 21/154 |

*Primary Examiner* — Sundhara M Ganesan
*Assistant Examiner* — Jacqueline N L Loberiza
(74) *Attorney, Agent, or Firm* — Dority & Manning, P.A.

(57) ABSTRACT

A training system is provided herein that includes a training device and a timing device. The training device includes a frame, one or more pulleys operably coupled with the frame, and a cable routed through the one or more pulleys. The timing device is coupled to the training device and includes a housing operably coupled with the training device, a sensor configured to detect motion between a first position and a second position, and a computing system positioned within the housing and operably coupled with the sensor. The computing system is configured to calculate a time between the first position and second position. The calculated time is provided on one or more displays of the timing device.

19 Claims, 17 Drawing Sheets

(56) References Cited

U.S. PATENT DOCUMENTS

| | | | | |
|---|---|---|---|---|
| 10,765,900 | B2 | 9/2020 | Lacey | |
| 11,123,609 | B2 * | 9/2021 | Rubin | A63B 21/0058 |
| 2010/0197462 | A1 * | 8/2010 | Piane, Jr. | A63B 21/00 482/8 |
| 2010/0197467 | A1 | 8/2010 | Hector | |
| 2010/0233664 | A1 | 9/2010 | Wroclawsky | |
| 2010/0285930 | A1 * | 11/2010 | Tedhams | A63B 69/12 192/103 B |
| 2013/0267384 | A1 | 10/2013 | Eldridge | |
| 2014/0038777 | A1 | 2/2014 | Bird | |
| 2014/0097285 | A1 | 4/2014 | Chang | |
| 2015/0290517 | A1 | 10/2015 | Saleh | |
| 2016/0121194 | A1 | 5/2016 | Chuang | |
| 2018/0243599 | A1 | 8/2018 | Lacey | |
| 2018/0345080 | A1 * | 12/2018 | Orfield | A61B 5/224 |
| 2019/0160335 | A1 * | 5/2019 | Bengtsson | A63B 21/0628 |
| 2020/0023226 | A1 * | 1/2020 | Silveira | A63B 21/0626 |

* cited by examiner

TRAINING SYSTEM

CROSS-REFERENCE TO RELATED APPLICATIONS

This application is a non-provisional application claiming the benefit of priority under 35 U.S.C. § 119(e) to U.S. Provisional Application No. 63/046,450, filed Jun. 30, 2020, which is hereby incorporated by reference in its entirety.

FIELD

The present disclosure generally relates to training systems, and in some instances, to athletic training systems.

BACKGROUND

Training systems are commonly utilized in training for competitions in various athletic events. In some instances, it may be desirable to have a more accurate timing device integrated within the training system.

BRIEF DESCRIPTION

Aspects and advantages of the present disclosure will be set forth in part in the following description, or may be obvious from the description, or may be learned through practice of the present disclosure.

According to some aspects of the present disclosure, a training system includes a training device including a frame, one or more pulleys operably coupled with the frame; and a cable routed through the one or more pulleys. The training system also includes a timing device coupled to the training device. The timing device includes a housing operably coupled with the training device and a sensor configured to detect motion between a first position and a second position. A computing system is positioned within the housing and operably coupled with the sensor. The computing system is configured to calculate a time between the first position and second position. The calculated time is provided on one or more displays of the timing device.

According to some aspects of the present disclosure, a method of operating a training system that includes a training device and a timing device is provided herein. The training device includes a base portion, one or more vertical supports, one or more brackets on an opposing side of the one or more vertical supports from the base portion, and a cable coupled to a weight system. The one or more brackets support one or more pulleys operably coupled with the cable. The method includes coupling the timing device to the one or more brackets. The method further includes attaching the cable to a swimmer. Lastly, the method includes transmitting data from a sensor of the timing device to a computing system of the timing device related to one or more statistics based on an extension of the cable from the training device by the swimmer.

According to some aspects of the present disclosure, a timing device for swimming includes a housing configured to operably couple with a training device. A sensor is configured to detect motion between a first position and a second position. A computing system is positioned within the housing and is operably coupled with the sensor. The computing system is configured to calculate one or more statistics based on movement of a component within the training device. A first display positioned within a first side portion of the housing. The calculated statistic is provided on the first display of the timing device.

These and other features, aspects, and advantages of the present technology will become better understood with reference to the following description and appended claims. The accompanying drawings, which are incorporated in and constitute a part of this specification, illustrate examples of the disclosure and, together with the description, serve to explain the principles of the present disclosure.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
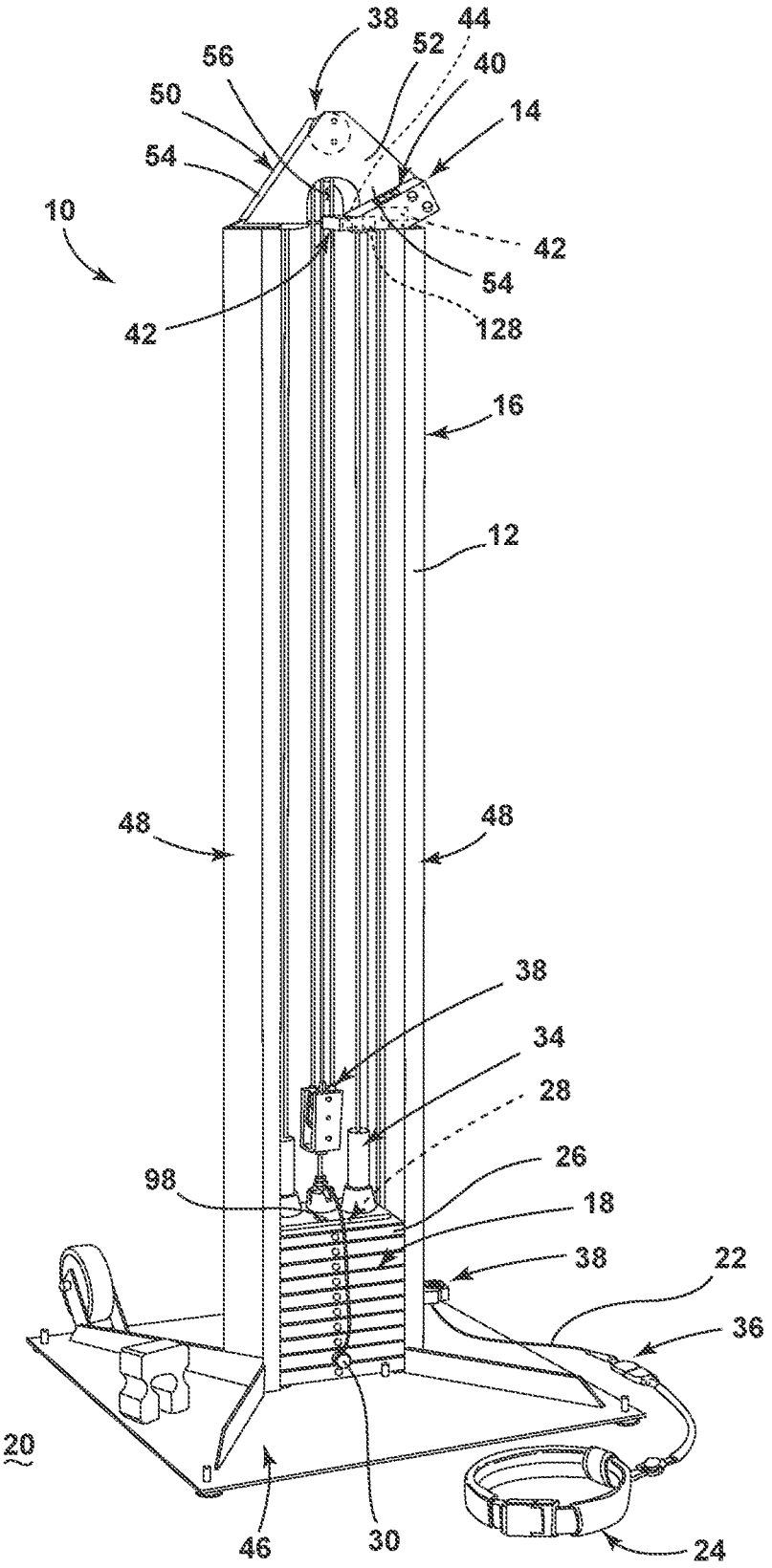
FIG. 1 is a perspective view of a training system having a training device and a timing device including a sensor, according to various aspects of the present disclosure.

Repeat use of reference characters in the present specification and drawings is intended to represent the same or analogous features or elements of the present technology.

DETAILED DESCRIPTION

For purposes of description herein, the terms "upper," "lower," "right," "left," "rear," "front," "vertical," "horizontal," and derivatives thereof shall relate to the example of the present disclosure as oriented in FIG. 1. However, it is to be understood that the present disclosure may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

As required, detailed examples of the present disclosure are disclosed herein. However, it is to be understood that the disclosed examples are merely exemplary of the present disclosure that may be embodied in various and alternative forms. The figures are not necessarily to a detailed design and some schematics may be exaggerated or minimized to show a function overview. Therefore, specific structural and functional details disclosed herein are not to be interpreted as limiting, but merely as a representative basis for teaching one skilled in the art to variously employ the present disclosure.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if any assembly or composition is described as containing components A, B, and/or C, the assembly or composition can contain A alone; B alone; C alone; A and B in combination; A and C in combination; B and C in combination; or A, B, and C in combination.

In general, the present subject matter of the present disclosure is related to a training system that can include a training device and a timing device operably coupled with the training device. The timing device can include a housing operably coupled with the training device. A sensor can be configured to detect motion between a first position, or an initial position and a second position, or an end position (and anything in between). A computing system can be positioned within the housing and operably coupled with the sensor. The computing system can be configured to calculate one or more statistics between the first position and second position, wherein the one or more statistics is provided on one or more displays of the timing device. In various examples, the one or more statistics can include a time to complete the repetition over a defined distance, a speed over the defined distance, a speed along various portions (e.g., every tenth of a second, every one-hundredth of a second, etc.) of the defined distance, an acceleration over the defined distance, an acceleration along various portions along the defined distance, a calculated force over the defined distance, a calculated force along various portions along the defined distance, a calculated power over the defined distance, a calculated power along various portions along the defined distance, etc. In examples in which statistics such as force and/or power are calculated, the timing device may be capable of automatically detecting an amount of weight that is provided by the training device and/or a user may manually input the amount of weight through a user interface of the timing device and/or a remote electronic device.

The timing device provided herein may be capable of being removably attached to various training devices and include various displays that provide information to both a user and an onlooker of the training system. In addition, the computing system may calculate various statistics based on the data received from the one or more sensors. The statistics provided by the computing system may provide additional and/or more precise data of a users' performance of the training device between intervals of a common workout and/or intervals from multiple workouts. In addition, the statistics may be saved, within the timing device and/or remotely, such that the user may be tracked over time and/or on various training devices. Accordingly, use of the system provided herein allows for a user to use the training device with the timing device without any additional help, which is unique when compared to many training devices that are currently commercially available.

Referring now to FIGS. 1-4, in some examples, a training system 10 may include a training device 12 and a timing device 14. For example, the training device 12 may be a device capable of providing resistance to a user. For instance, the user may be a swimmer and as a swimmer moves away from the training device 12, the swimmer's motion through the water is somehow resisted. Various devices can be used or proposed for implementing resistive training. The timing device 14 may be operably coupled with the training device 12 and configured to provide a metric of a user's performance. The performance may be compared to the user's other repetitions during a common training session, the user's repetitions during another training session, and/or to other users of the training system 10. As used herein, a "repetition" is any movement that is repeated and monitored by the timing device 14 for analysis as to each individual repetition and/or to other repetitions.

In the examples illustrated in the FIGS. 1-4, the training device 12 may include a frame 16 and a variable weight system 18. The training device 12 is configured to rest on a surface 20, such as dry land, a pool deck, or any one of numerous other suitable surfaces 20.

When assembled, a cable 22 may be tethered about a swimmer via, for example, a suitable harness 24 that may be readily coupled to and removed from the cable 22. With the variable weight system 18 loaded to a desired weight, the swimmer may then alternately swim away from and swim toward the training device 12. When swimming away from the training device 12, the swimmer will experience a resistive force. Conversely, when swimming toward the training device 12, the swimmer will experience an assistance force. Thus, the swimmer training device 12 may enable two different types of training, and does so without the swimmer experiencing a tug, jerk, catch, or loss of load associated with presently known swimmer training devices 12.

Figure 2:
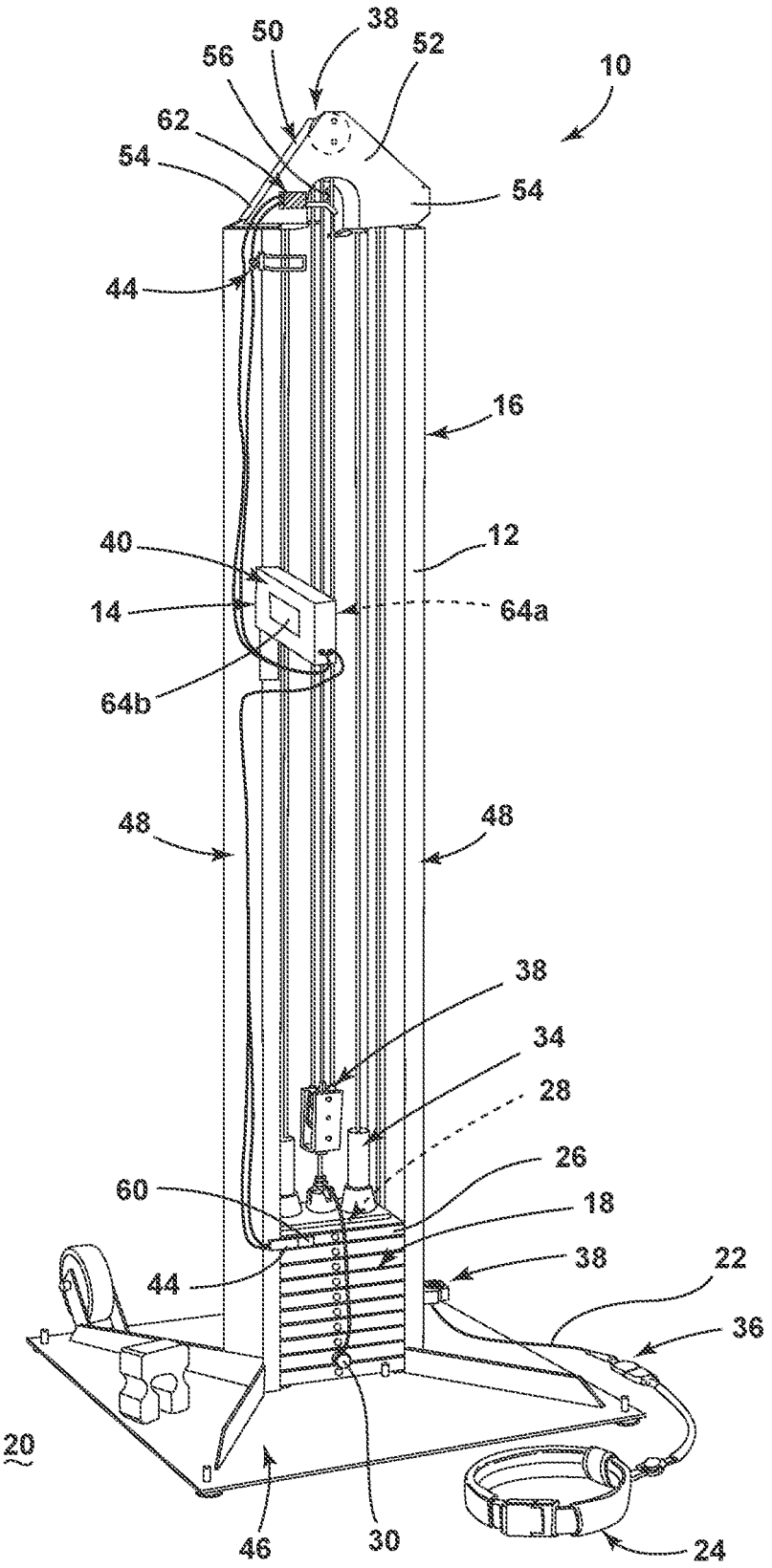
FIG. 2 is a perspective view of a training system having a training device and a timing device including a pair of sensors, according to various aspects of the present disclosure.
Figure 3:
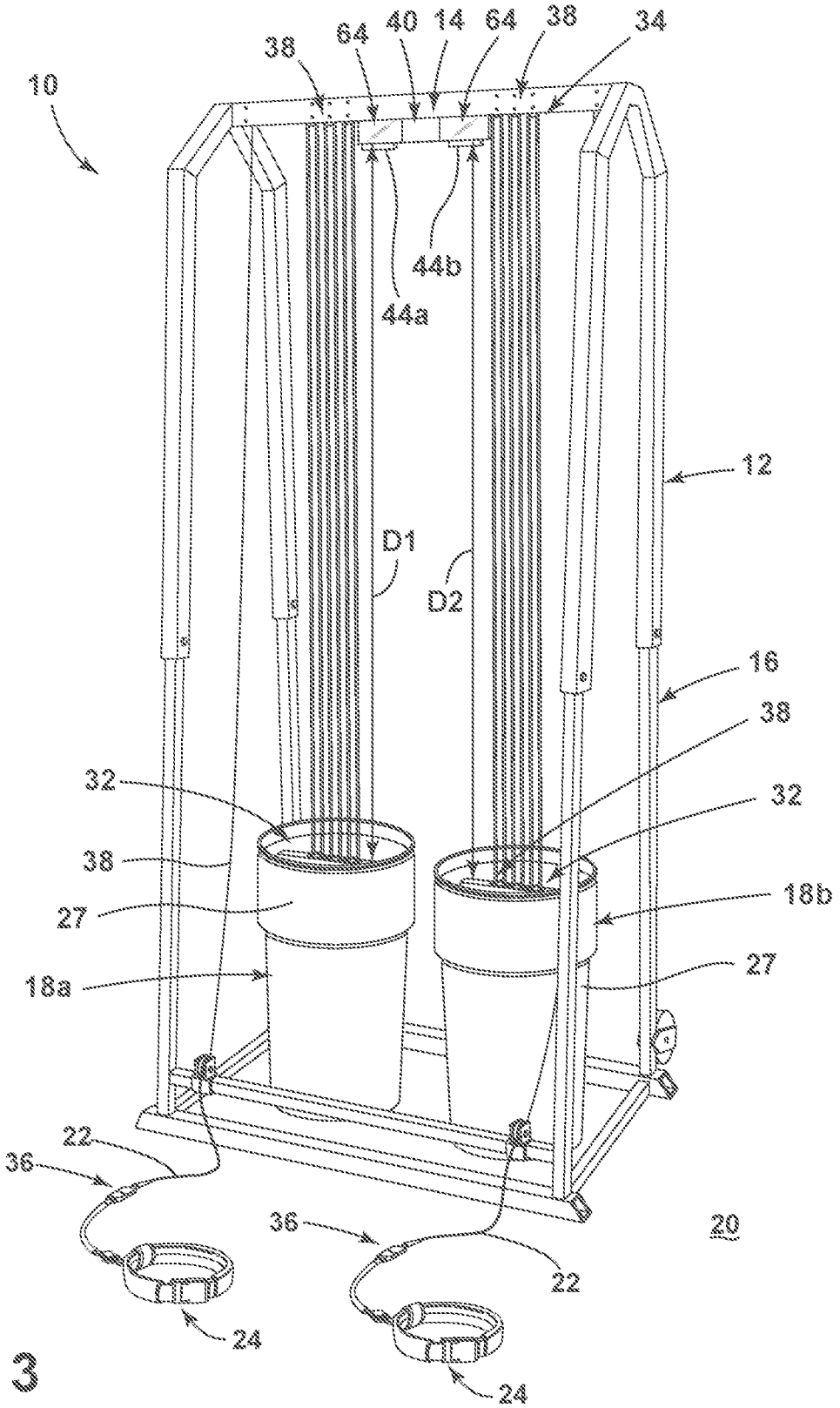
FIG. 3 is a perspective view of a training system having a training device including a pair of variable weight systems and a timing device including first and second sensors respectively coupled with each of the variable weight systems, according to various aspects of the present disclosure.
Figure 4:
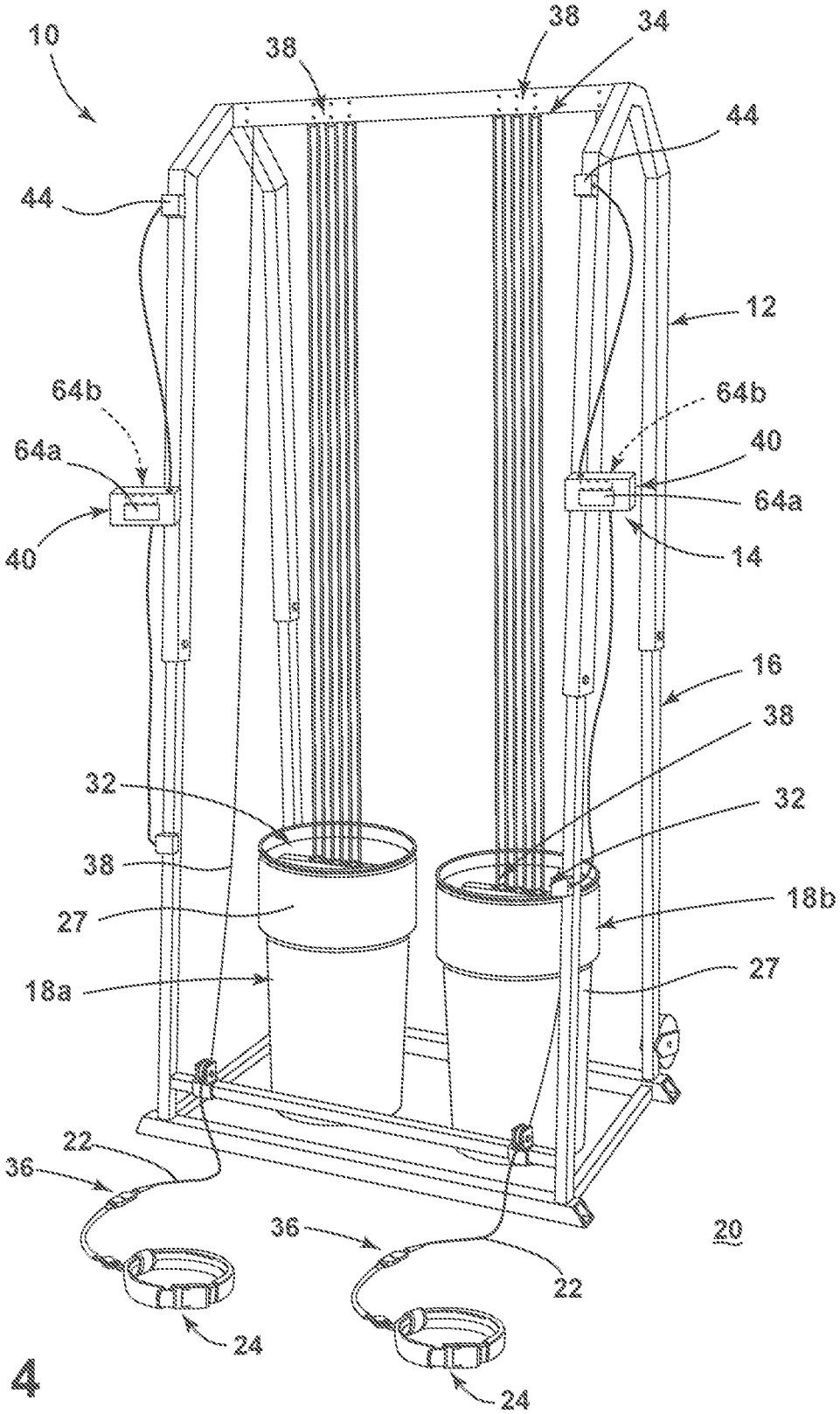
FIG. 4 is a perspective view of a training system having a training device including a pair of variable weight systems and a timing device including first and second pairs of sensors respectively coupled with each of the variable weight systems, according to various aspects of the present disclosure.

In some examples, as shown in FIGS. 1-4, the variable weight system 18 may include one or more of stacked weight plates 26, as illustrated in FIGS. 1 and 2, or a fillable weight device 27 (such as a bucket), as illustrated in FIGS. 3 and 4, positioned within a portion of the frame 16. In examples including one or more stacked weight plates 26, each weight plate 26 can be configured to provide a specified weight force (e.g., each weight plate 26 may weigh about ten pounds (about 4.5 kilograms)). In examples including the fillable weight device 27, the fillable weight device 27 may have one or more markings thereon to provide assistance obtaining a specified weight force (e.g., each marking may indicate an amount of water that weighs about ten pounds (about 4.5 kilograms)).

In some examples, a weight selecting device may be configured to be positioned through or along the stacked weight plates 26 of the variable weight system 18 to facilitate the selection of a number of stacked weight plates 26 to be coupled to a cable 22, and thus to facilitate the amount of weight to be applied to the cable 22.

In various examples, a weight selector rod 28 may be sized for insertion through vertical apertures of the stacked weight plates 26. The weight selector rod 28 may include a plurality of apertures, each aperture of the plurality of apertures corresponding to a weight plate 26 of the weight system 18. A weight selector pin 30 may be inserted into a horizontal aperture of a selected weight plate 26 and a corresponding aperture of the plurality of apertures of the selector rod 28 at a position corresponding to a desired number of weight plates 26, and thus a desired weight, to be attached to the cable 22. In other examples, the fillable weight device 27 may include an attachment structure 32 that can operably couple a bucket to the cable 22, as illustrated in FIGS. 3 and 4.

The cable 22 may include a first end portion 34 coupled to the variable weight system 18 and/or the frame 16 and a second end portion 36 coupled to a harness 24. The cable 22 may be routed through one or more pulleys 38. The pulleys 38 may comprise a wheel rotatable about an axle. The pulleys 38 may be positioned to direct and position the cable 22 about the training device 12 and facilitate a full range of motion of the components of the training device 12.

Referring still to FIGS. 1-4, the timing device 14 may be operably coupled with the training device 12 and configured to monitor or time one or more repetitions of the training device 12 by a user. For example, the timing device 14 may include a housing 40 that includes a computing system 42 and one or more sensors 44 operably coupled with the computing system 42. The one or more sensors 44 may be configured to detect movement of the variable weight system 18. For example, the sensors 44 may detect when the variable weight system 18 begins to move from the first position and when the variable weight system 18 reaches a predefined second position. The computing system 42 may be configured to calculate a statistic between the first position and second position. As illustrated in the various examples provided in FIGS. 1-4, the timing device 14 may be coupled with various portions of the training device 12 (or may be remote from the training device 12). In addition, in various examples, the sensors 44 and/or the computing system 42 may be disposed remote from the cable 22 and/or the variable weight system 18.

Referring further to FIGS. 1 and 2, in some examples, the frame 16 of the training device 12 may include a base portion 46, a pair of vertical supports 48, and a top portion 50. The top portion 50 may include one or more brackets 52 that attach to one or both of the vertical supports 48. In addition, the brackets 52 may also support one or more pulleys 38 that are operably coupled with the cable 22. In some examples, the one or more brackets 52 may define a pair of side portions 54 and a void 56 between the two side portions 54. In some instances, one or more pulleys 38 may be positioned above the void 56 and one or more additional pulleys 38 may be supported by one of the side portions 54 of the bracket 52. In such instances, the cable 22 may be operably coupled with the variable weight system 18, and routed through the one or more pulleys 38 positioned above the void 56. From the one or more pulleys 38 above the void, the cable 22 may be routed around the one or more pulleys 38 coupled with a side portion 54 of the bracket 52 and along an outer side of one of the vertical supports 48. A lower pulley 38 may be coupled with the vertical support 48 such that the cable 22 may be pulled away from the training device 12 while the variable weight system 18 moves in a generally vertical direction.

In various examples, the timing device 14 may be configured to couple with the one or more brackets 52. For example, in some examples, the timing device 14 may be coupled with the bracket 52 on an opposing side of the void from the pulley 38 that is operably coupled with a side portion 54 of the bracket 52. In some examples, such as the one illustrated in FIG. 1, the timing device 14 may extend laterally into the void and include one or more sensors 44 that detect movement of the variable weight system 18 positioned below the timing device 14. In various examples, the sensor 44 may be configured as a proximity sensor, such as a LIDAR sensor, a RADAR sensor, an imaging sensor, and/or any other type of sensor that is capable of measuring the distance from the sensor 44 to the variable weight system 18. However, it will be appreciated that in some instances, the timing device 14 may be operably coupled with the variable weight system 18 and move with the variable weight system 18. Accordingly, in such instances, the sensor 44 may be configured to measure the distance between the variable weight system 18 and the frame 16 as the timing device 14 and the variable weight system 18 moves relative to the frame 16.

In some instances, when the distance between the variable weight system 18 and the timing device 14 decreases, a timer of the computing system 42 begins a count. The timing is counted until the variable weight system 18 reaches a predefined distance from the upper portion of the training device 12, which may be detected by the sensor 44. Based on the monitored distance over time, one or more statistics may be calculated. In various examples, the one or more statistics can include time to complete the repetition over a defined distance, a speed over the defined distance, a speed along various portions along the defined distance, an acceleration over the defined distance, an acceleration along various portions along the defined distance, a calculated force over the defined distance, a calculated force along various portions along the defined distance, a calculated power over the defined distance, a calculated power along various portions along the defined distance, etc. In examples in which statistics such as force and/or power are calculated, the timing device may be capable of automatically detecting an amount of weight that is provided by the training device and/or a user may manually input the amount of weight through a user interface of the timing device and/or a remote electronic device. In some instances, the sensor 44 may additionally or alternatively be configured as a rotary encoder that is coupled with one or more pulleys 38 of the training device 12. In some instances, a plate 98 may be attached to a top portion of the variable weight system 18 to increase the precision of the timing device 14. In such examples, the plate 98 may be formed from a reflective material thereby forming a reflective plate 98. In such instances, the sensor 44 can be optically coupled with the reflective plate 98 during at least a portion of a timing sequence.

In some instances, the timer of the computing system 42 may also be utilized for defining a repetition time. For example, a user may define the amount of time between the start of each repetition, which may be inputted into the computing system 42. In response, the timing device 14 may provide a countdown on one or more of the displays **64*a*, 64*b*, a remote electronic device 110 (FIG. 27), or through any other display. In some examples, the timing device 14** may include and/or be operably coupled with a speaker, which may indicate a remaining amount of time before the user is to start the next repetition.

In some examples, such as the one illustrated in FIG. 2, the timing device 14 may be coupled with one of the vertical supports 48 and include an upper and/or a lower sensor 44.

In some instances, the lower sensor 44 may be generally vertically aligned or just above the variable weight system 18, when the variable weight system 18 is in the first position. The upper sensor 44 may be positioned proximately to an upper portion of the vertical supports 48 and define the end point for the travel of the variable weight system 18. In various examples, the sensors 44 can be configured as laser sensors, ultrasonic sensors, magnetic sensors (with a magnet 60 attached on the variable weight system 18), motion sensors, photosensors, image sensors, a distance sensor, and/or any other type of sensor. In some instances, a vibration sensor can be attached to the timing device 14 to measure the vibration that occurs when the weight begins to move and/or contacts an upper portion of the training device 12. Additionally, in some instances, the timing device 14 may include a limit switch 62 that may be operably coupled with one of the brackets 52. As illustrated in FIGS. 1 and 2, the timing device 14 may also include one or more displays 64*a*, 64*b*. A first display 64*a* may be positioned within a first side portion of the housing and generally face the lower pulley 38 of the training device 12, which may be generally visible to a user of the training device 12. A second display 64*b* may be positioned on any other second side portion of the housing 40 and visible to an onlooker of the training device 12. Each display may be configured to provide common information and/or varied information relative to one another. For instance, the first display 64*a* may be configured to provide a first set of information while the second display 64*b* may be configured to provide a second set of information with the first set of information differing from the second set of information. Additionally or alternatively, the first display 64*a* and the second display 64*b* may be configured to provide the first set of information simultaneously and/or at varied times. In addition, each display may be capable of providing a graph of one or more of the statistics over one or more repetitions. Additionally, statistics over multiple repetitions may be graphed on a common grid for comparative analysis.

Referring to FIGS. 3 and 4, in some instances, the training device 12 may include more than one variable weight system 18 such that multiple users may independently utilize the training device 12. In such instances, the timing device 14 may be operably coupled with each of the variable weight systems 18 of the training device 12 and configured to independently monitor each variable weight system 18. For example, as illustrated in FIG. 3, the timing device 14 may include a first sensor 44*a* that is operably coupled with a first weight device 18*a* and a second sensor 44*b* that is operably coupled with a second weight device 18*b*. In addition, the timing device 14 may include first and second displays 64*a* on a first side in which the first side is common with a side of the training device 12 having first and second lower pulleys 38. Accordingly, the first and second displays 64*a* are visible to users of the training device 12. In addition, one or more additional displays 64*b* may be positioned on an opposing side, or any other portion, of the timing device 14 that are visible to an onlooker of the timing device 14.

Figure 5:
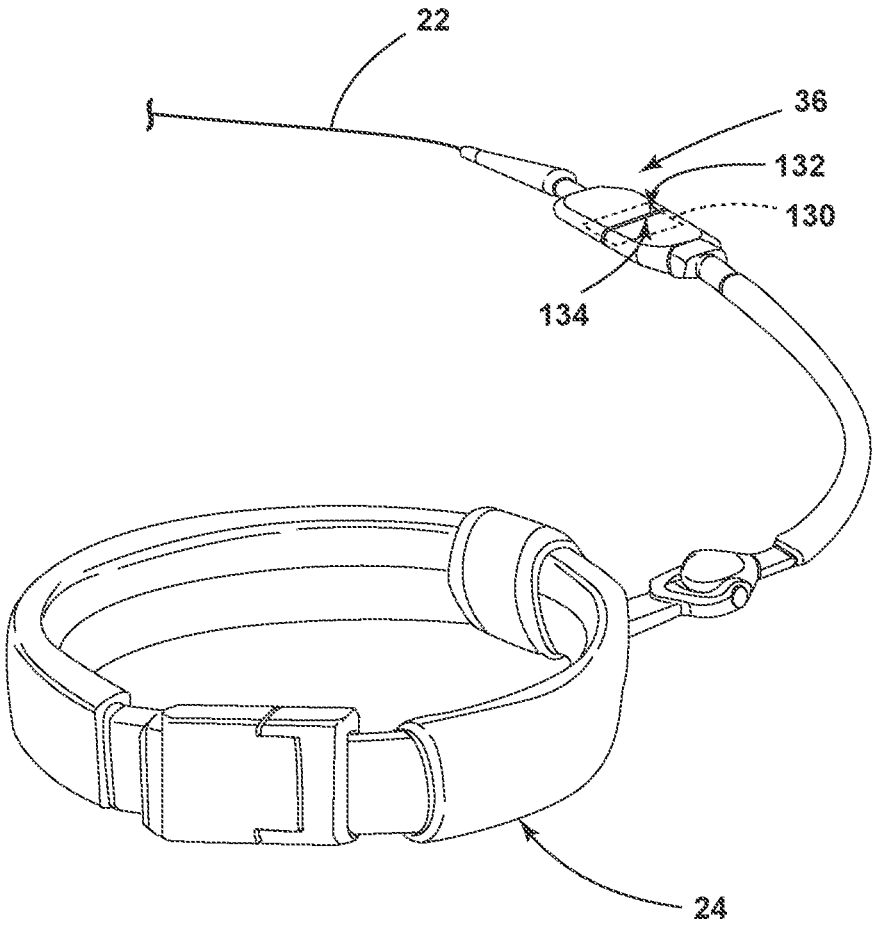
FIG. 5 is a perspective view of a belt that may be operably coupled with the training device.
Figure 7:
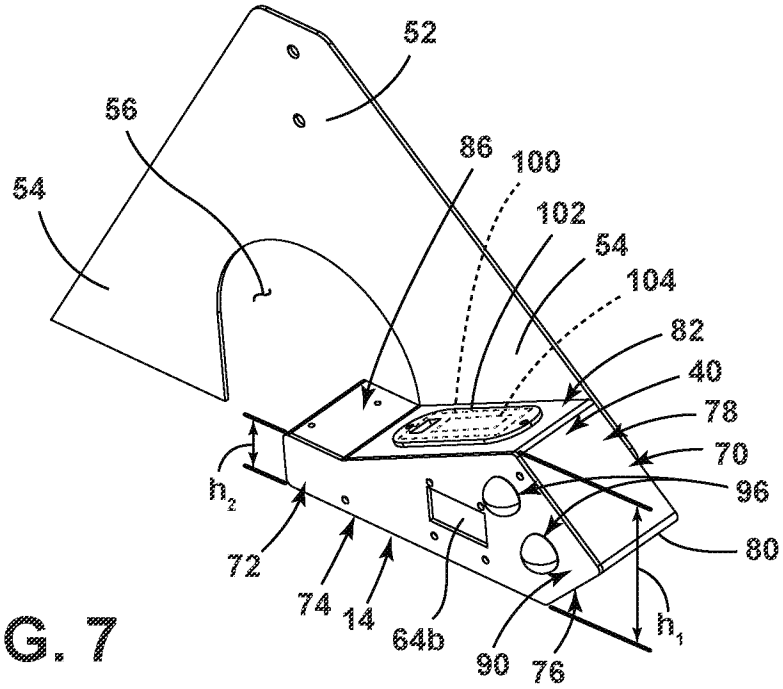
FIGS. 6-26 illustrate various views of the timing device, according to various aspects of the present disclosure.
Figure 6:
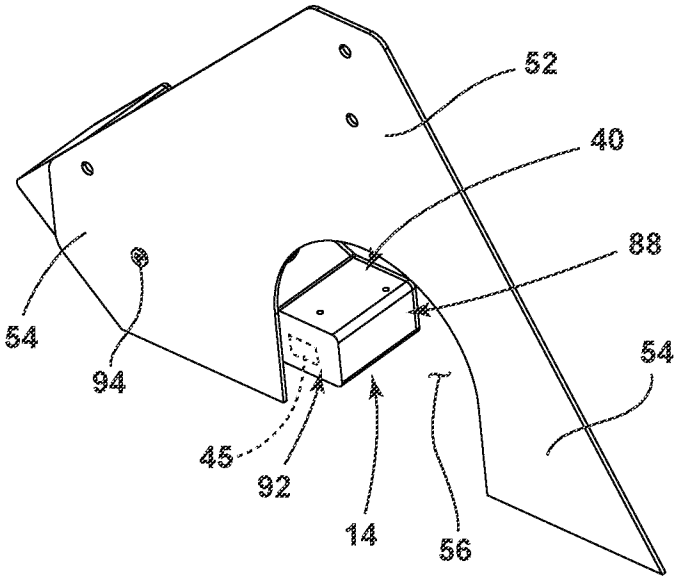
Figure 8:
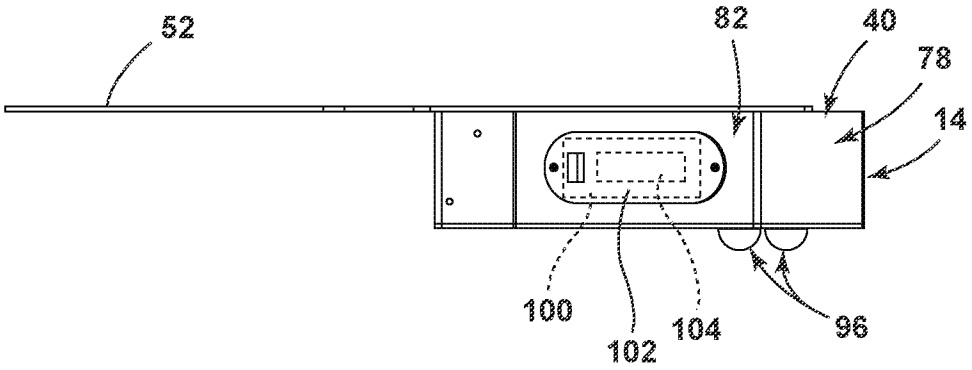
Figure 10:
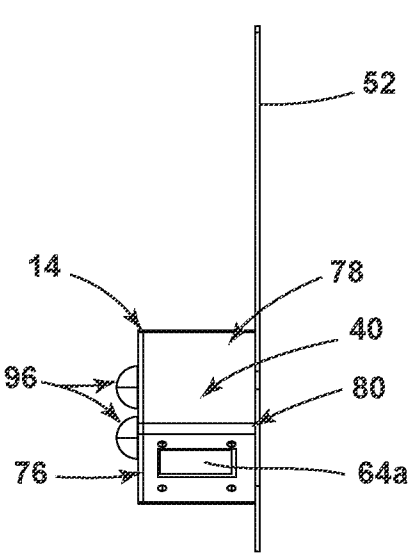
Figure 9:
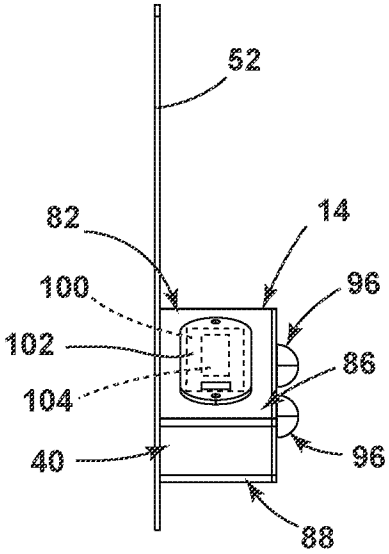
Figure 11:
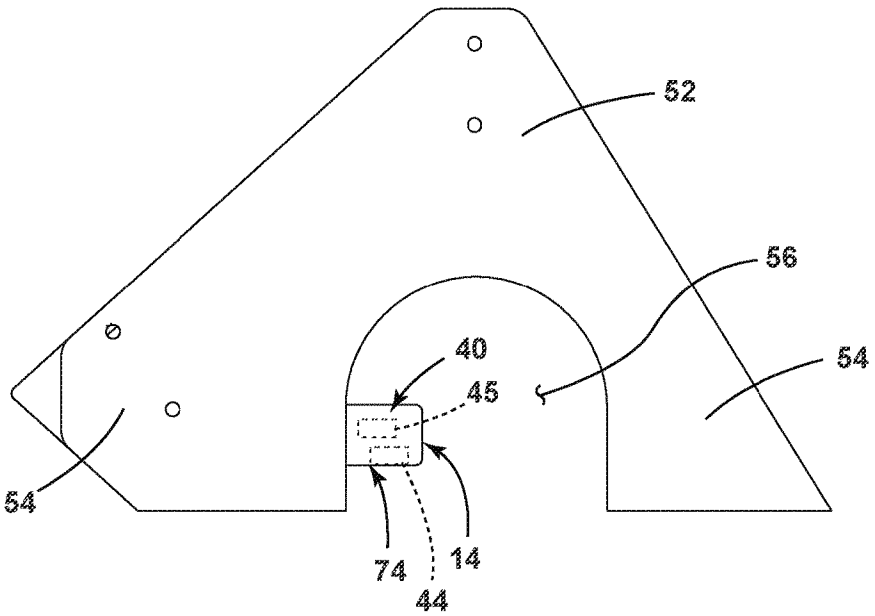
Figure 12:
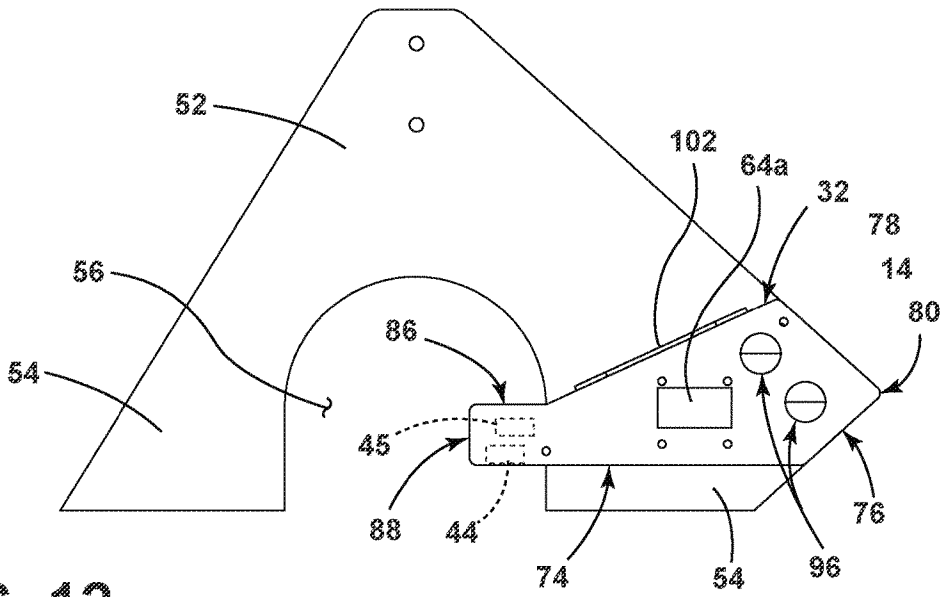
Figure 13:
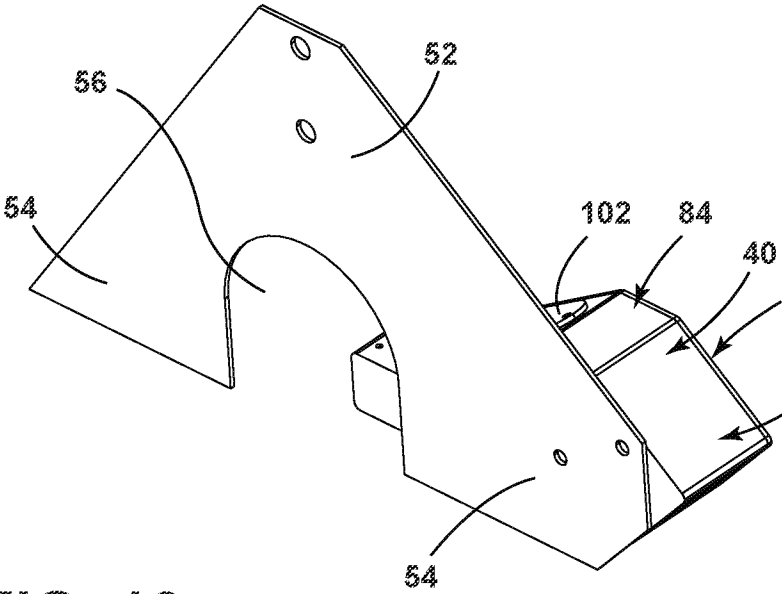
Figure 14:
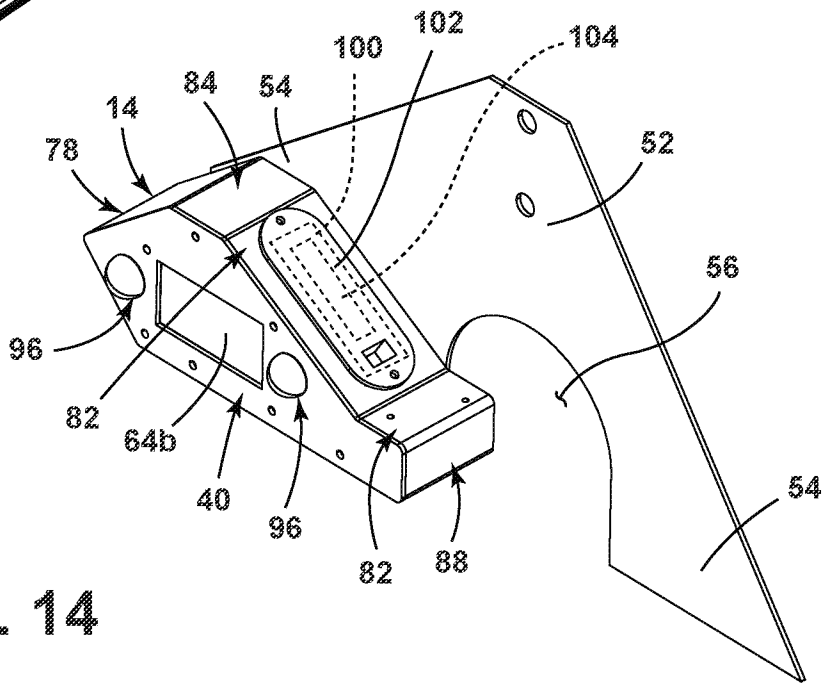
Figure 15:
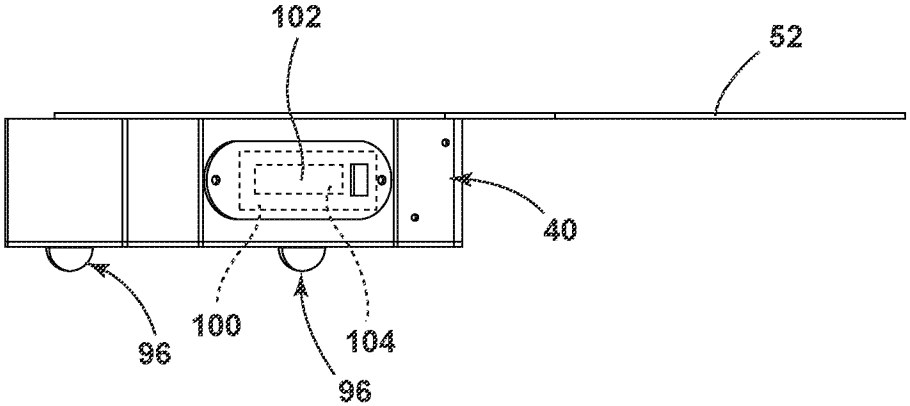
Figure 16:
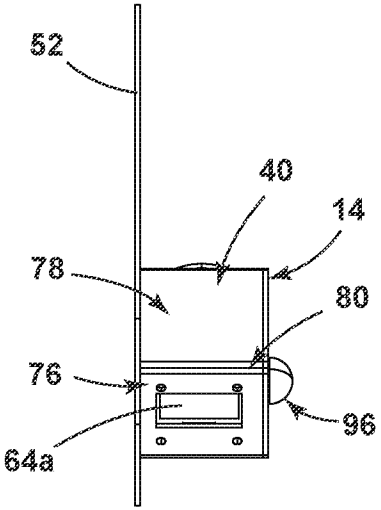

Referring to FIG. 5, in some instances, the harness 24 may be configured as a belt or any other attachment device that may be coupled to the cable 22. In some instances, a swivel assembly 66 may be disposed between the cable 22 and the harness 24 for releasably coupling the harness 24 to the cable 22. In various examples, the swivel assembly 66 may be configured to release the belt from the cable 22 when a predefined amount of force is placed on the cable 22. For example, the swivel assembly may have first and second coupling portions 132, 134. Accordingly, the swivel assembly 66 may assist in preventing the training device 12 from being pulled from in its initial and/or into a pool due to excessive force.

In some instances, the predefined amount of force may be adjustable through the swivel assembly 66 based on the amount of resistance provided from the training device 12 and/or may be adjusted by an adjustment device 130. For example, when a large amount of weight is to be pulled by a user, the predefined amount of force may be adjusted through the adjustment device 130 versus when a smaller amount is to be pulled by the user. In various examples, the adjustment may be made through various features integrated within the first coupling portion 132 and/or the second coupling portion 134 that allow for an amount of separating force to be altered. For instance, the contact portions may include moveable magnets. In such instances, as additional magnets are positioned along the contact portions, the predefined amount of force may be increased versus when a smaller amount is to be pulled by the user. Additionally or alternatively, any other attachment device may be positioned along the contact portions to adjust the predefined amount of force.

Figure 27:
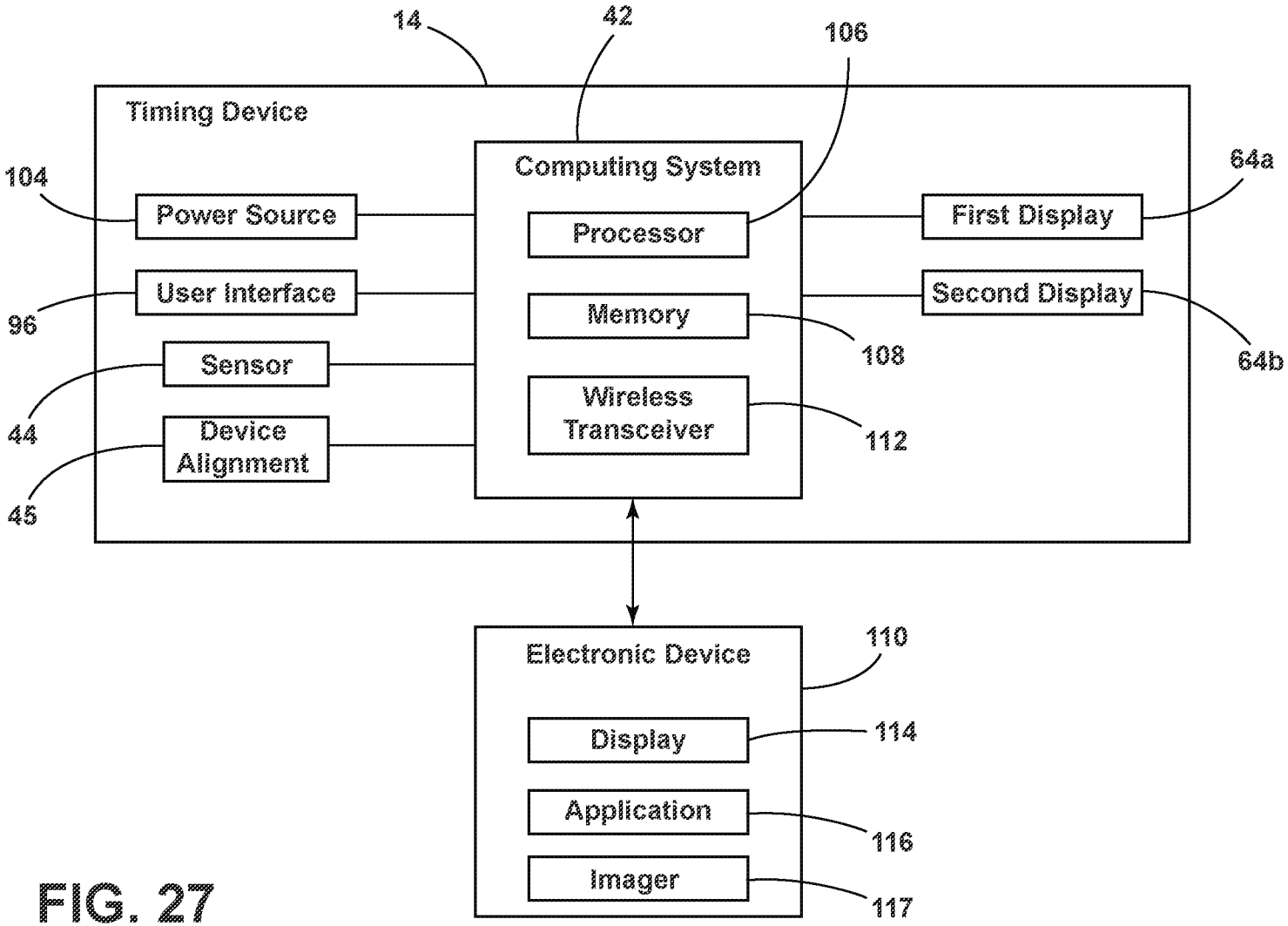
FIG. 27 is a block diagram illustrating the timing device, according to various aspects of the present disclosure.

Referring now to FIGS. 6-26, various features of the timing device 14 may be supported by the housing 40. For instance, in various examples, the one or more sensors 44, one or more displays 64*a*, 64*b*, one or more user input devices, a computing system 42, and a power source 104 may be operably coupled with the housing 40. As provided herein, the training device 12 may be capable of calculating one or more statistics over each repetition. Each statistic may be provided on one or more displays 64*a*, 64*b* of the timing device 14 and/or on a remote electronic device 110 (FIG. 27).

As illustrated in FIGS. 6-19, the housing 40 may include an outer portion 70 having a first height $h_1$ and an inner portion 72 having a second height $h_2$, In some instances, the second height $h_2$ may be less than the first height $h_1$. Further, in some instances, the housing 40 may include a bottom surface 74 that may be generally parallel to a ground surface 20 when attached to the training device 12. The outer portion 70 of the housing 40 may include first and second offset outer surfaces 76, 78 that include an outwardly extending edge 80 therebetween. A first top surface 82 may extend from the second outer surface 78 towards the inner portion 72 of the housing 40 and/or from a transition surface 84. An inner, second top surface 86 may be vertically offset and/or generally parallel with the bottom surface 74. An inner side surface 88 may couple the inner top surface 86 and the bottom surface 74. Front and rear surfaces 90, 92 may be positioned on opposing sides of the bottom side, and top surfaces. The rear surface 92 may be positioned along the bracket 52, or any other portion, of the training device 12. In some instances, an adhesive may be used for attaching the timing device 14 to the training device 12. Additionally, and/or alternatively, one or more fasteners 94 may be utilized for retaining the timing device 14 on the training device 12. In instances in which a fastener is utilized, the bracket 52 may define one or more holes and a fastener 94 may be disposed through the one or more holes defined by the bracket and into a fastener receiving portion of the housing 40. In some instances, the housing 40 and the respective fastener receiving portions of the housing 40 may be orientated based on the available fastener holes of the bracket 52. Additionally or alternatively, in various examples, a magnet, a clamp, and/or any other fastening device may be utilized. Through the use of various attachment devices, the timing device 14 may be portable and universal such that the device may be used with various training devices 12. In various examples, the housing 40 may generally align with the bracket 52 once attached thereto.

In some examples, a first display 64*a* may be positioned on an outer side surface, such as the first outer surface 76. Accordingly, the first display 64*a* may be oriented towards a user, and possibly, downwards toward a user. A second display 64*b* may be positioned on the forward surface 90 of the housing 40 such that the second display 64*b* may be visible to an onlooker, such as a coach. In various examples, the first and second displays 64*a*, 64*b* may be configured as any practicable type of display. For instance, the displays 64*a*, 64*b* may be configured as an OLED display, an LED display, an LCD display, a capacitive touch display, a resistive touch display, and/or any other type of display.

In some examples, the first display 64*a* that may be angled towards the user may be configured to provide a calculated time for the most recent repetition, time, and/or any other practicable information. In various examples, the first display is configured to provide a first set of information while the second display is configured to provide a second set of information. For example, the second display 64*b* may be configured to show the most recent repetition, time, and/or additional information, such as an average time for multiple repetitions by the user, a power ratio, an average velocity, a velocity graph, a best (or quickest) time for a repetition, a remaining power indicator, etc. In various examples, the computing system may be configured to monitor various trend lines within the data and/or the graph, which are representative of various activities during the repetition. For example, based on the data, the computing system may be configured to detect a push-off length, a first stroke length, the time between each stroke, a turnover rate, etc. In addition, in various examples, the first and second displays 64*a*, 64*b* may be of differing sizes, resolution, aspect ratio, backlighting, etc.

A user interface 96 may also be provided on the housing 40, which may be in the form of one or more buttons. The user interface 96 may toggle the displays 64*a*, 64*b* between various information and/or alter one or more settings of the timing device 14. In some examples, the user interface 96 may also power the computing system 42 on and off. Additionally or alternatively, the user interface 96, and/or an electronic device 110 (FIG. 27), may be utilized to define a starting position and/or an end position of the variable weight system 18 of the training device 12. For instance, in some examples, with the variable weight system 18 in the initial position, a user may interact with the user interface 96 (e.g., press one or the one or more buttons). In response, the sensor 44 may detect an initial distance between the sensor 44 and the variable weight system 18, which is then stored within a computing system 42 of the timing device. Further, in some examples, with the variable weight system 18 in the final position, a user may interact with the user interface 96 (e.g., press one or the one or more buttons). In response, the sensor 44 may detect a final distance between the sensor 44 and the variable weight system 18, which is then stored within a computing system 42 of the timing device. As such, an initial position may be defined as the initial distance and a final position may be defined as the final distance. In such instances, the user interface 96 may be used to calibrate the initial position and the final position of the timing sequence.

In some embodiments, an alignment device 45 may be operably coupled with the housing 40. The alignment device 45 may be configured to provide data to the computing system 42 indicative of an orientation of the housing 40. For example, in several embodiments, the alignment device 45 may correspond to a gyroscope and/or an inertial motion unit (IMU). However, it should be appreciated that, in alternative embodiments, the alignment device 45 may be configured as any suitable acceleration sensing device and/or position detecting device for detecting a position of the housing 40. With the data provided by the alignment device 45, the computing system 42 may determine whether the sensor 44 is aligned with the variable weight system 18. For instance, the computing system 42 may determine whether the housing 40, and thus, the sensor 44, are positioned in a defined orientation and/or a user can store a detected position of the housing 40 within the computing system 42. With a defined positioned stored, the computing system 42 may confirm that in subsequent uses, the housing 40 is positioned in a generally common position. With the sensor 44 aligned, the sensor 44 may be configured to detect movement of the variable weight system 18. It will be appreciated that the alignment device 45 may be a separate component from the sensor 44 and/or the alignment device 45 and the sensor 44 may be a common component without departing from the teachings of the present disclosure.

In some embodiments, if the computing system 42 determines that the housing 40 and sensor 44 are misaligned from a defined orientation based on data provided by the alignment device 45, the computing system 42 may generate a notification. The notification may be provided on the one or more displays 64*a*, 64*b* and/or an electronic device 110. In some instances, the notification may further provide graphics showing a direction of misalignment to assist a user in positioning the sensor 44 in a defined orientation relative to the variable weight system 18.

With further reference to FIGS. 6-19, the housing 40 may also define a power source cavity 100 in a portion thereof. A cover 102 may be positioned over the power source cavity 100 and can provide a generally watertight seal in some instances. A power source 104 may be positioned within the power source cavity 100 and be electrically coupled with the computing system 42 of the training system 10. In various examples, the power source 104 may be configured as a rechargeable battery, which may be nine volts and/or any other voltage. In some instances, a power generation assembly 128 (FIG. 1) may be operably coupled with the training device 12 that generates electric energy from one or more moving components of the training device 12. In other examples, the computing system 42 may be operably coupled with a remote power source 104.

Referring to FIGS. 20-26, in some examples, the sensor 44 may be configured to detect linear motion. For instance, the timing device 14 may be positioned on a training device 12, such as a tripod, and configured to measure an object, such as a user, as the user moves from a first position to a second position. Accordingly, in such instances, the timing device 14 may be used for ground based motion, such as running, walking, vertical jumping, long jumping, etc. When used in such implementations, the timing device 14 may be capable of including any or all of the features provided herein. For instance, the one or more displays 64*a*, 64*b* may be capable of providing any desired statistic that may be measured through a repetition.

Referring to FIG. 27, in various examples, the timing device 14 may include a computing system 42 communicatively coupled to one or more components of the timing device 14 to allow the operation of such components to be electronically or automatically controlled by the computing system 42. For instance, the computing system 42 may be communicatively coupled to the one or more sensors 44 and/or the one or more displays 64*a*, 64*b*. During operation, the one or more sensors 44 are configured to detect movement of the variable weight system 18 from a first position to a second position.

In some examples, the computing system 42 may be configured to compute one or more statistics based on the detected movement of the variable weight system 18 from a first position to a second position. For example, based on the apex of various portions of the graph, the computing system 42 may be capable of detecting various portions of the repetition, such as a push-off time time/distance (amount of time underwater), a number of kicks during the push-off time/distance, a number of strokes during the repetition, or any other activity that may occur during a repetition. Each activity may be detected through one or more algorithms within the computing system 42. In various examples, the computing system 42 may additionally store various statistics for other users for comparative analysis. For example, a user may compare their performance to others to determine whether the user is above average/average/below average. In some instances, through the user interface 96, the remote electronic device 110, or any other device, the comparative data may be set based on a user's sex, age, ability level, etc.

In general, the computing system 42 may include one or more processor-based devices, such as a given controller or computing device or any suitable combination of controllers or computing devices. Thus, in several examples, the computing system 42 may include one or more processor(s) 106, and associated memory device(s) 108 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 108 of the computing system 42 may generally comprise memory element(s) including, but not limited to, a computer-readable medium (e.g., random access memory RAM)), a computer-readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 108 may generally be configured to store suitable computer-readable instructions that, when implemented by the processor(s) 106, configure the computing system 42 to perform various computer-implemented functions, such as one or more aspects of the methods and algorithms that will be described herein. In addition, the computing system 42 may also include various other suitable components, such as a communications circuit or module, one or more input/output channels, a data/control bus and/or the like.

It should be appreciated that the various functions of the computing system 42 may be performed by a single processor-based device or may be distributed across any number of processor-based devices, in which instance such devices may be considered to form part of the computing system 42.

The computing system 42 may provide instructions for various other components communicatively coupled with the computing system 42 based on the results of the data analysis. For example, the computing system 42 may provide display instructions to the one or more displays 64*a*, 64*b* and/or a remote electronic device 110.

The timing device 14 may communicate via wired and/or wireless communication with the remote electronic devices 110 through a transceiver 112. The network may be one or more of various wired or wireless communication mechanisms, including any combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary wireless communication networks include a wireless transceiver (e.g., a BLUETOOTH module, a ZIGBEE transceiver, a Wi-Fi transceiver, an IrDA transceiver, an RFID transceiver, etc.), local area networks (LAN), and/or wide area networks (WAN), including the Internet, providing data communication services.

The electronic device 110 may also include a display 114 for displaying information to a user. For instance, the electronic device 110 may display one or more graphical user interfaces through an application 116 and may be capable of receiving remote user-inputs to set a predefined preference for operation or data analysis of the timing device 14. In addition, the electronic device 110 may provide feedback information, such as visual, audible, and tactile alerts. It will be appreciated that the electronic device 110 may be any one of a variety of computing devices and may include a processor and memory. For example, the electronic device 110 may be a cell phone, mobile communication device, key fob, wearable device (e.g., fitness band, watch, glasses, jewelry, wallet), apparel (e.g., a tee shirt, gloves, shoes, or other accessories), personal digital assistant, headphones and/or other devices that include capabilities for wireless communications and/or any wired communications protocols.

Figure 28:
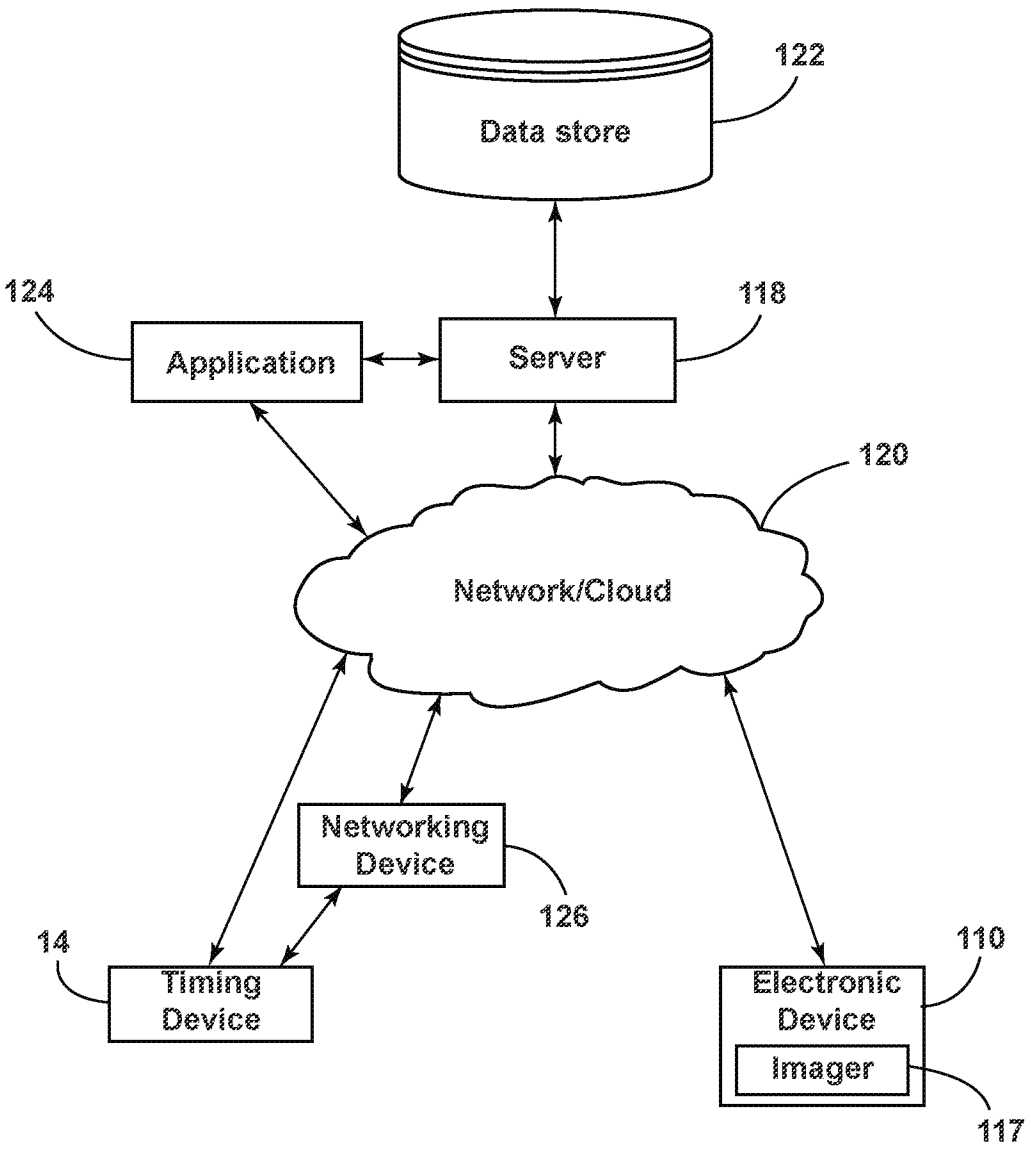
FIG. 28 is a block diagram of the timing device operably coupled with a remote server, according to various aspects of the present disclosure.

Referring to FIG. 28, in some examples, the timing device 14 may be communicatively coupled with one or more remote sites such as a remote server 118 via a network/cloud 120. The network/cloud 120 represents one or more systems by which the timing device 14 may communicate with the remote server 118. Accordingly, the network/cloud 120 may be one or more of various wired or wireless communication mechanisms, including any desired combination of wired and/or wireless communication mechanisms and any desired network topology (or topologies when multiple communication mechanisms are utilized). Exemplary communication networks 120 include wireless communication networks (e.g., using Bluetooth, IEEE 802.11, etc.), local area networks (LAN) and/or wide area networks (WAN), including the Internet and the Web, which may provide data communication services and/or cloud computing services. The Internet is generally a global data communications system. It is a hardware and software infrastructure that provides connectivity between computers. In contrast, the Web is generally one of the services communicated via the Internet. The Web is generally a collection of interconnected documents and other resources, linked by hyperlinks and URLs. In many technical illustrations when the precise location or interrelation of Internet resources are generally illustrated, extended networks such as the Internet are often depicted as a cloud (e.g. 120 in FIG. 28). The verbal image has been formalized in the newer concept of cloud computing. The National Institute of Standards and Technology (NIST) provides a definition of cloud computing as "a model for enabling convenient, on-demand network access to a shared pool of configurable computing resources (e.g., networks, servers, storage, applications, and services) that can be rapidly provisioned and released with minimal management effort or service provider interaction." Although the Internet, the Web, and cloud computing are not exactly the same, these terms are generally used interchangeably herein, and they may be referred to collectively as the network/cloud 120.

The server 118 may be one or more computer servers, each of which may include at least one processor and at least one memory, the memory storing instructions executable by the processor, including instructions for carrying out various steps and processes. The server 118 may include or be communicatively coupled to a data store 122 for storing collected data as well as instructions for operating timing device 14 that may be directed to and/or implemented by the timing device 14 with or without intervention from a user and/or the electronic device 110.

In some examples, the instructions may be inputted through the electronic device 110 and relayed to the server 118. Those instructions may be stored in the server 118 and/or data store 122. At various predefined periods and/or times, the timing device 14 may communicate with the server 118 through the network/cloud 120 to obtain the stored instructions, if any exist. Upon receiving the stored instructions, the timing device 14 may implement the instructions. The server 118 may additionally store information related to multiple timing devices 14, usage characteristics, errors, etc., and operate and/or provide instructions to the timing device 14 in conjunction with the stored information with or without intervention from a user and/or the electronic device 110.

With further reference to FIG. 28, the server 118 also generally implements features that may enable the timing device 14 to communicate with cloud-based applications 124. Communications from the timing device 14 can be directed through the network/cloud 120 to the server 118 and/or cloud-based applications 124 with or without a networking device 126, such as a router and/or modem. Additionally, communications from the cloud-based applications 124, even though these communications may indicate one of timing device 14 as an intended recipient, can also be directed to the server 118. The cloud-based applications 124 are generally any appropriate services or applications 124 that are accessible through any part of the network/cloud 120 and may be capable of interacting with the timing device 14.

In various examples, the electronic device 110 can be feature-rich with respect to communication capabilities, i.e. have built in capabilities to access the network/cloud 120 and any of the cloud-based applications 124 or can be loaded with, or programmed to have, such capabilities. The electronic device 110 can also access any part of the network/cloud 120 through industry standard wired or wireless access points, cell phone cells, or network nodes. In some examples, users can register to use the remote server 118 through the electronic device 110, which may provide access the timing device 14 and/or thereby allow the server 118 to communicate directly or indirectly with the timing device 14. In various instances, the timing device 14 may also communicate directly, or indirectly, with the electronic device 110 or one of the cloud-based applications 124 in addition to communicating with or through the server 118. According to some examples, the timing device 14 can be preconfigured at the time of manufacture with a communication address (e.g. a URL, an IP address, etc.) for communicating with the server 118 and may or may not have the ability to upgrade or change or add to the preconfigured communication address.

Referring still to FIG. 28, when a new cloud-based application 124 is developed and introduced, the server 118 can be upgraded to be able to receive communications for the new cloud-based application 124 and to translate communications between the new protocol and the protocol used by the timing device 14. The flexibility, scalability, and upgradeability of current server technology renders the task of adding new cloud-based application protocols to the server 118 relatively quick and easy.

With further reference to FIG. 28, in some examples, the electronic device 110 may include an imager 117 that is configured to detect or capture image data or other vision-based data (e.g., point cloud data) that is provided to the server 118 and/or the computing system 42. In turn, the system 10 may be capable of determining one or more characteristics of the training device 12. For example, the one or more characteristics may be related to the specific training device 12 being used. With the training device 12 detected, the computing system 42 may determine various settings of the particular training device 12. For example, the settings may relate to an initial position and/or a final position of the variable weight, a length of movement of the cable 22 (FIG. 1) of the weight system 18 (FIG. 1), a set of algorithms to evaluate the detected amount of time, etc. Additionally or alternatively, the imager 117 may be used to provide image data of a user of the system 10. In such instances, one or more settings may be updated and/or data generated by the sensor 44 while in use by the detected user may be stored in a manner in which the data may be related to the detected user.

The imager 117 may correspond to any suitable sensing device configured to detect or capture image data or other vision-based data (e.g., point cloud data). For example, in several embodiments, the imager 117 may correspond to a suitable camera configured to capture images of the field, such as three-dimensional images of the training device 12 and/or the user within the associated field of view. For instance, in several embodiments, the imager 117 may correspond to a stereographic camera having two or more lenses with a separate image sensor for each lens to allow the camera to capture stereographic or three-dimensional images. However, in alternative embodiments, the imager 117 may correspond to Light Detection and Ranging (LIDAR) sensor or any other suitable vision-based sensing device.

In some instances, the methods and algorithms of the processor(s) 106 of the computing system 42, the processor(s) of the electronic device 110, and/or the at least one processor of the server 118 can be implemented using a machine learning engine (MLE) that utilizes one or several machine learning techniques including, for example, decision tree learning, including, for example, random forest or conditional inference trees methods; neural networks; support vector machines; clustering; and Bayesian networks. These algorithms can include computer-executable code that can be retrieved by the memory 108 of the computing system 42, the memory of the electronic device 110, and/or the remote server 118 and used to generate a predictive evaluation of the training device characteristics.

Figure 29:
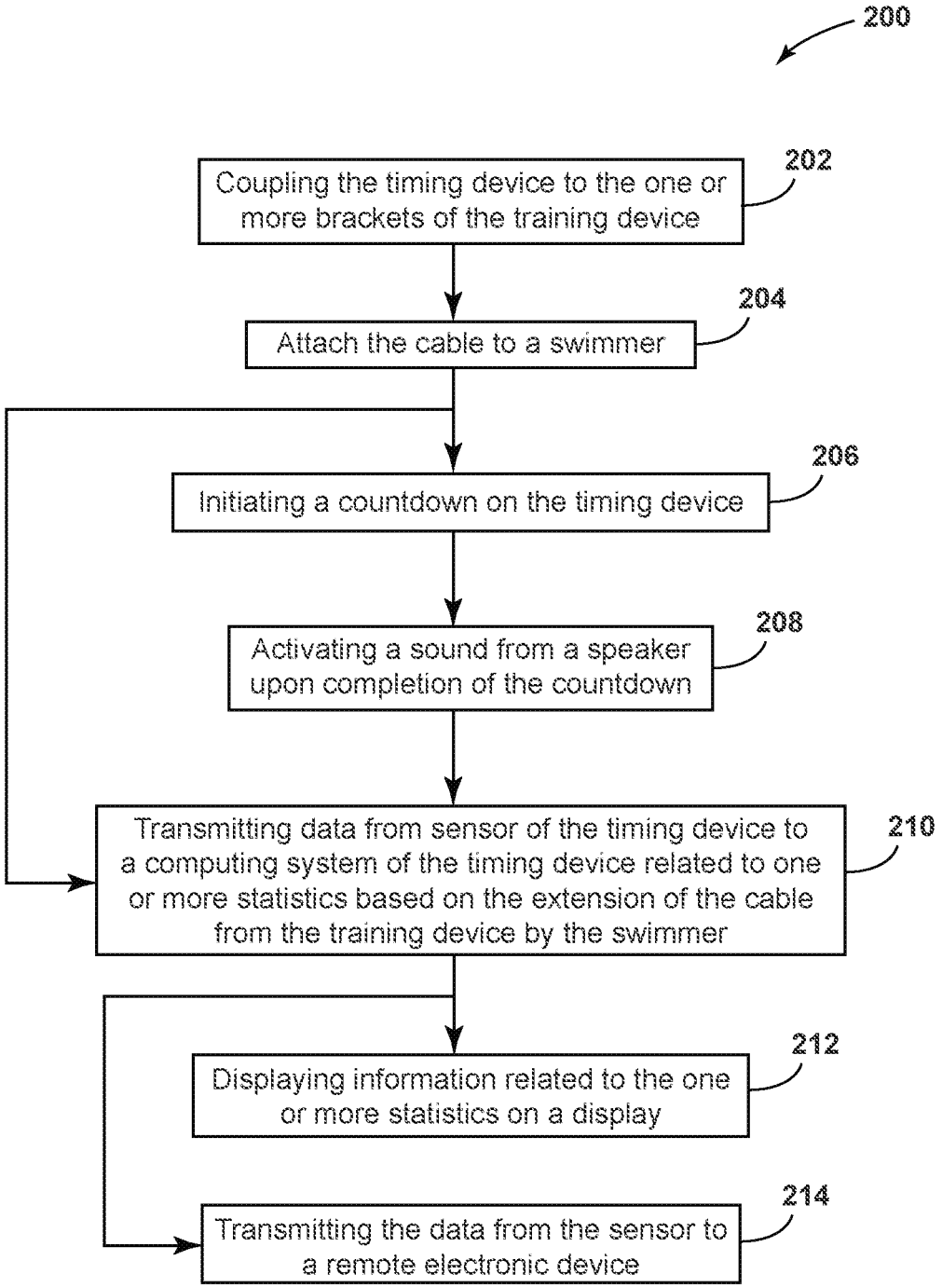
FIG. 29 is a flow diagram of a method for the operation of a training system in accordance with aspects of the present disclosure.

In various examples, the processor(s) 222 of the computing system 42, the processor(s) 244 of the electronic device 110, the server 118, and/or an individual may classify training device characteristics based on various defined features. Additionally or alternatively, in several instances, the various types of training device 12 characteristics could be captured during the use of the training device 12. Each set of data related to the training device 12 characteristics can be manually analyzed to associate each real-world training device characteristics with a specific training device 12. That set of the data (the combination of real-world bale characteristics with associated cost) can then be utilized as a set of training data used to train an MLE to perform an automated evaluation of training device characteristics to determine a specific training device 12 being used in association with the timing device. In response, the computing system 42 may determine various settings of the particular training device 12. Referring now to FIG. 29, a flow diagram of some embodiments of a method 200 for the operation of a training system including a training device and a timing device is illustrated in accordance with aspects of the present subject matter. In general, the method 200 will be described herein with reference to the training system 10 described above with reference to FIGS. 1-28. However, it will be appreciated by those of ordinary skill in the art that the disclosed method 200 may generally be utilized with any suitable training system 10 and/or may be utilized in connection with any other timing device. In addition, although FIG. 29 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As provided herein, the training device can include a base portion, one or more vertical supports, and one or more brackets on an opposing side of the one or more vertical supports from the base portion. A cable can be coupled to a weight system. The one or more brackets can support one or more pulleys operably coupled with the cable. In operation, the cable may be tethered about a swimmer via, for example, a suitable harness that may be readily coupled to and removed from the cable. With the weight system loaded to a desired weight, the swimmer may then alternately swim away from and swim toward the training device. When swimming away from the training device, the swimmer will experience a resistive force. Conversely, when swimming toward the training device, the swimmer will experience an assistance force. Thus, the swimmer training device may enable two different types of training, and does so without the swimmer experiencing a tug, jerk, catch, or loss of load associated with presently known swimmer training devices.

Figure 17:
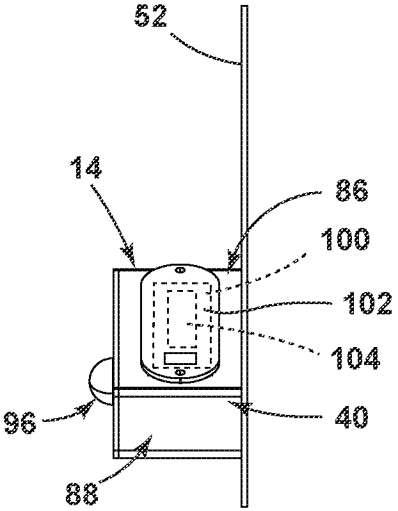
Figure 18:
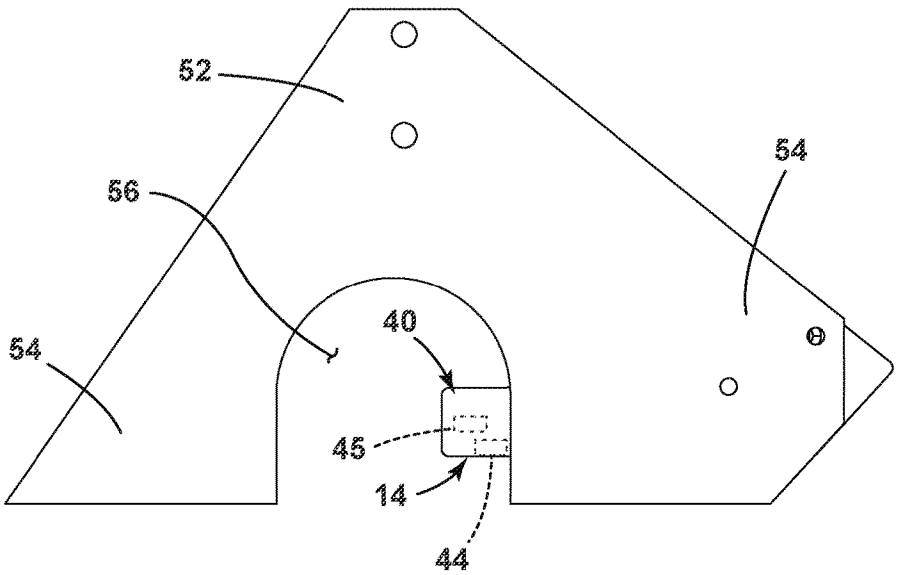
Figure 19:
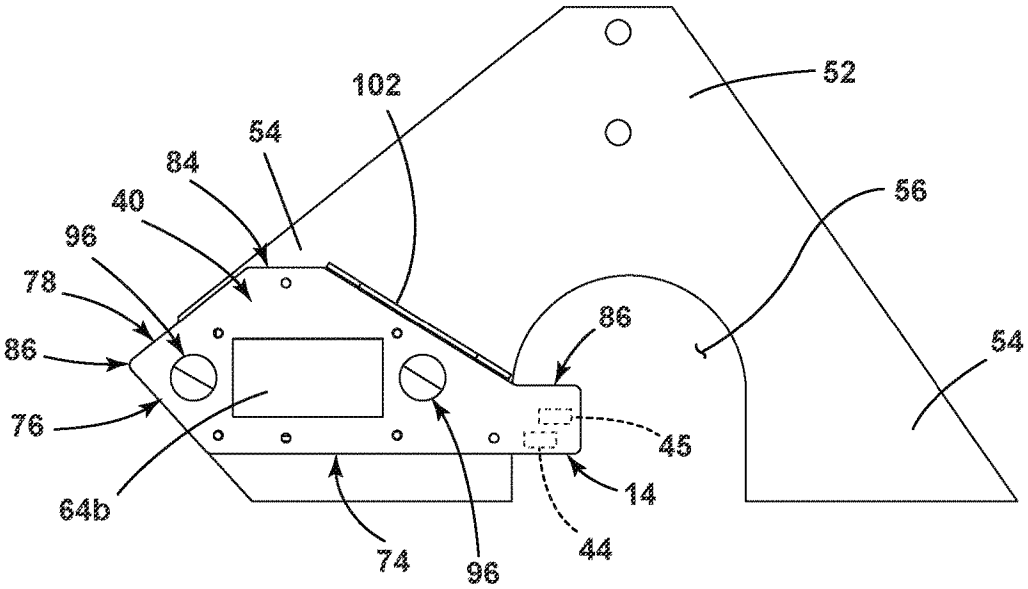
Figure 21:
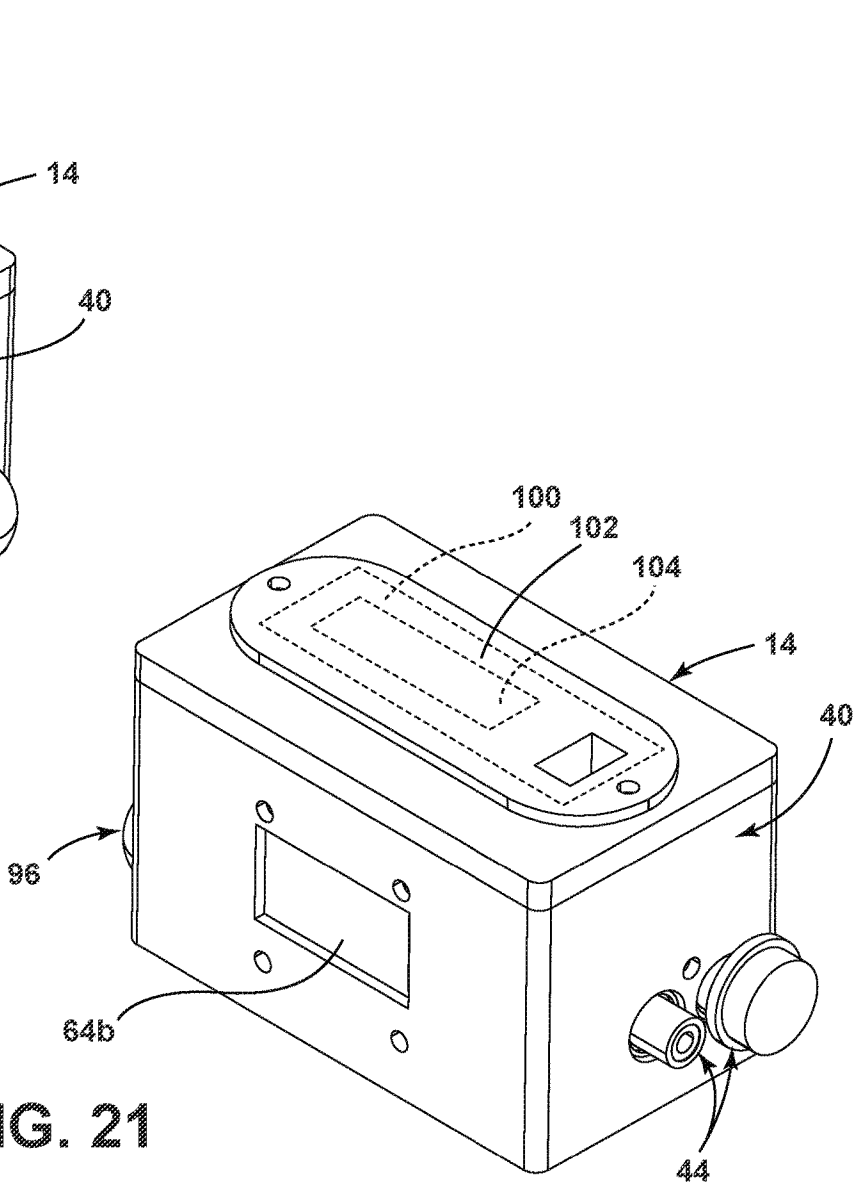
Figure 20:
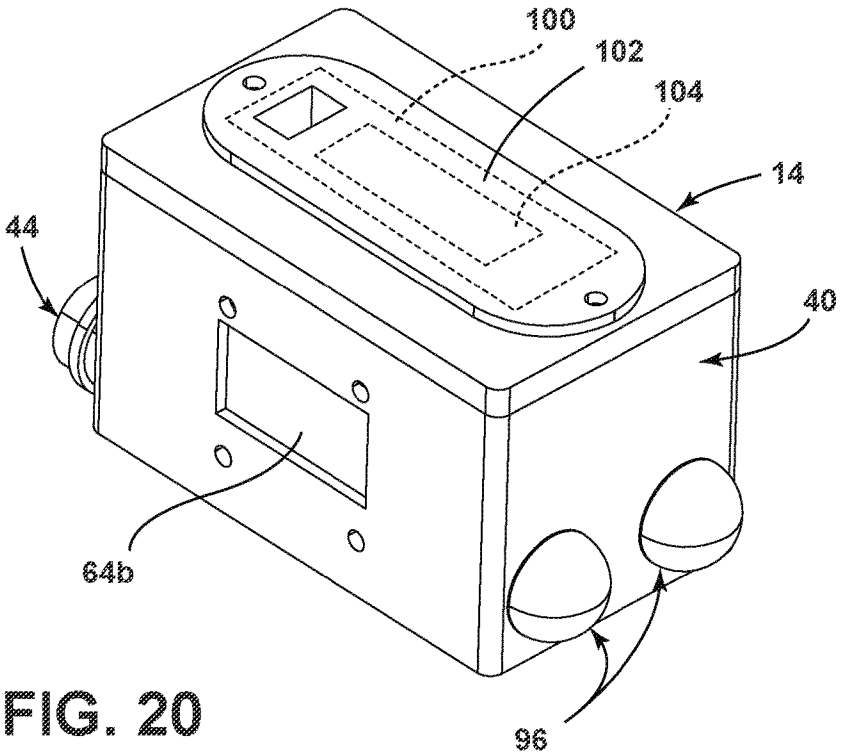
Figure 22:
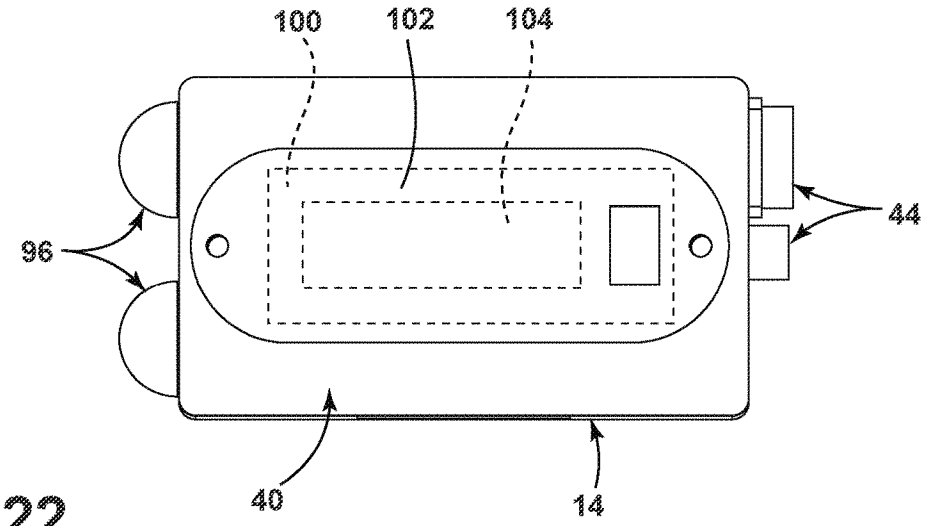
Figure 23:
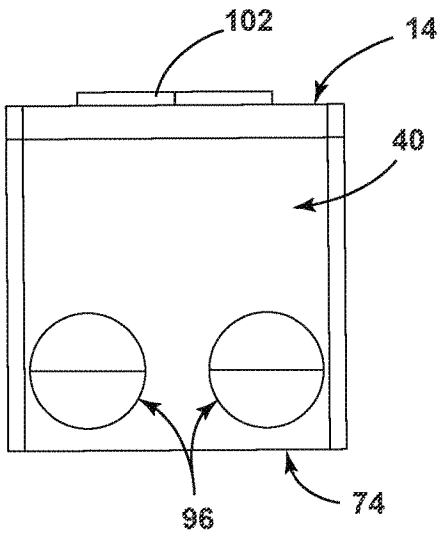
Figure 24:
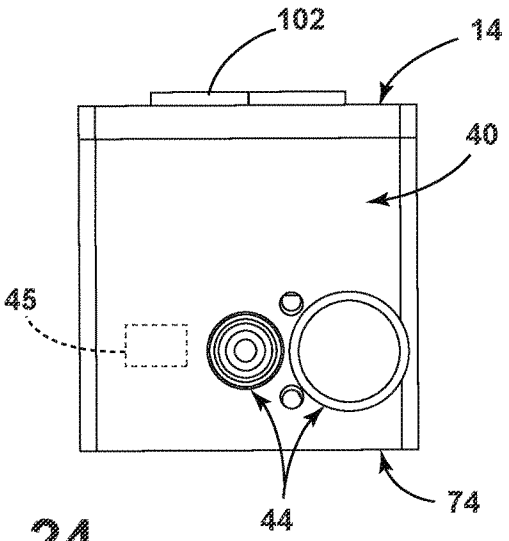
Figure 25:
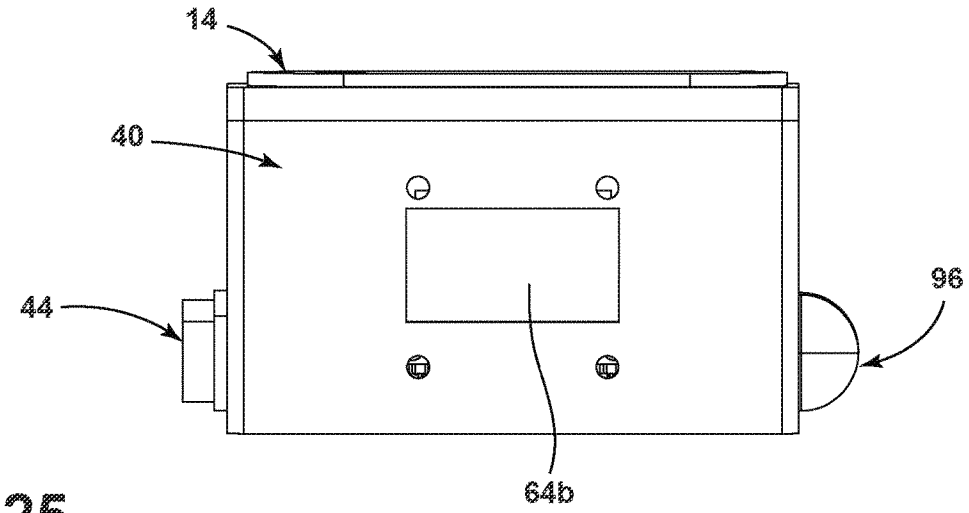
Figure 26:
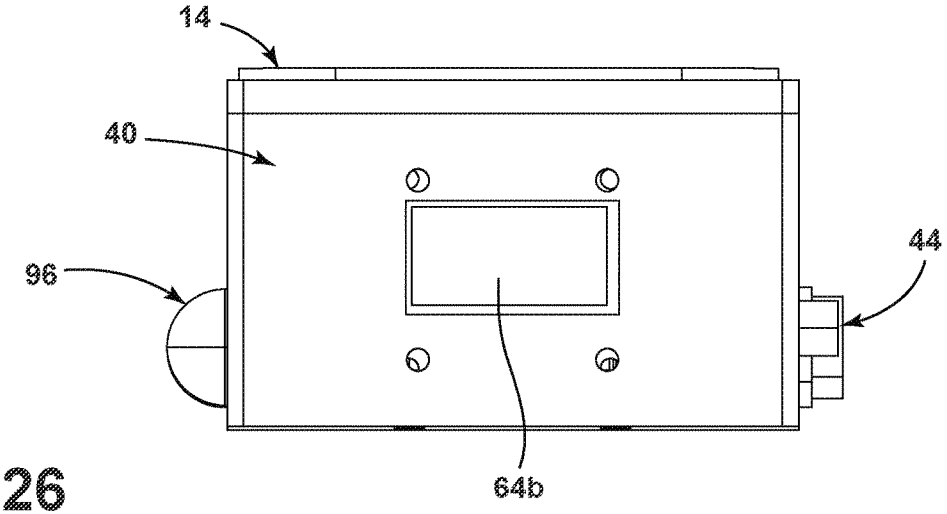

As shown in FIG. 17, at (202), the method 200 can include coupling the timing device to the one or more brackets of the training device. In some examples, the timing device may extend laterally into a void of the one or more brackets and include one or more sensors that detect movement of the weight system. In some instances, the method may include providing data related to the training device to the training device from a remote electronic device. For example, the remote electronic device may include an imager that is configured to detect or capture image data or other vision-based data (e.g., point cloud data) that is provided to the server and/or the computing system. In turn, the method may include determining one or more characteristics of the training device. For example, the one or more characteristics may be related to the specific training device being used.

At (204), the method 200 can include attaching the cable to a swimmer. As discussed above, a harness may be coupled to the cable. The harness may be configured as a belt or any other attachment device that may be attached to the swimmer. In some instances, a swivel assembly may be disposed between the cable and the harness for releasably coupling the harness to the cable. In various examples, the swivel assembly may be configured to release the belt from the cable when a predefined amount of force is placed on the cable. For example, the swivel assembly may have first and second coupling portions. Accordingly, the swivel assembly may assist in preventing the training device from being pulled from in its initial and/or into a pool due to excessive force. In such instances, attaching the cable to the swimmer may include coupling the cable with a first coupling portion of a swivel assembly, coupling a harness with a second coupling portion of the swivel assembly, coupling the first coupling portion of the swivel assembly with the second coupling portion of the swivel assembly.

At (206), the method 200 can include initiating a countdown on the timing device. At (208), the method 200 can include activating a sound from a speaker upon completion of the countdown. Additionally or alternatively, the one or more sensors may be configured to detect movement of the variable weight system. For example, the sensors may detect when the variable weight system 18 begins to move from the first position and when the variable weight system reaches a predefined second position. The computing system may be configured to calculate a statistic between the first position and second position.

At (210), the method can include transmitting data from a sensor of the timing device to a computing system of the timing device related to one or more statistics based on the extension of the cable from the training device by the swimmer. In turn, at (212), the method 200 can include displaying information related to the one or more statistics on a display operably coupled with a housing of the timing device. Additionally or alternatively, at (214), the method 200 can include transmitting the data from the sensor to a remote electronic device.

It is to be understood that the steps of any method disclosed herein may be performed by a computing system upon loading and executing software code or instructions which are tangibly stored on a tangible computer-readable medium, such as on a magnetic medium, e.g., a computer hard drive, an optical medium, e.g., an optical disc, solid-state memory, e.g., flash memory, or other storage media known in the art. Thus, any of the functionality performed by the computing system described herein, such as any of the disclosed methods, may be implemented in software code or instructions which are tangibly stored on a tangible computer-readable medium. The computing system loads the software code or instructions via a direct interface with the computer-readable medium or via a wired and/or wireless network. Upon loading and executing such software code or instructions by the controller, the computing system may perform any of the functionality of the computing system described herein, including any steps of the disclosed methods.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

A variety of advantages may be derived from the use of the present disclosure. For example, the use of the system and method provided herein can allow for a user of a training device to time each repetition. In addition, various statistics of each repetition may be calculated and stored by the timing device.

It will be understood by one having ordinary skill in the art that construction of the described invention and other components is not limited to any specific material. Other exemplary examples of the invention disclosed herein may be formed from a wide variety of materials unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

Furthermore, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected" or "operably coupled" to each other to achieve the desired functionality, and any two components capable of being so associated can also be viewed as being "operably couplable" to each other to achieve the desired functionality. Some examples of operably couplable include, but are not limited to, physically mateable, physically interacting components, wirelessly interactable, wirelessly interacting components, logically interacting, and/or logically interactable components.

It is also important to note that the construction and arrangement of the elements of the invention as shown in the examples are illustrative only. Although only a few examples of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting. In addition, variations and modifications can be made on the aforementioned structures and methods without departing from the concepts of the present invention and such concepts are intended to be covered by the following claims unless these claims by their language expressly state otherwise.

What is claimed is:

1. A training system, comprising:

a training device including a frame comprising one or more brackets positioned on an opposing side of one or more vertical supports from a base portion, wherein at least one of the one or more brackets defines a pair of side portions and a void between the two side portions;

one or more pulleys operably coupled with the one or more brackets;

a cable routed through the one or more pulleys and configured to operably couple with a swimmer;

a variable weight system operably coupled with the cable;

a timing device coupled with the bracket of the training device and including:

a housing operably coupled with the training device, wherein the housing is configured to extend into the void of one or more brackets; and a sensor positioned within the housing and at least partially above the one or more brackets and configured to detect motion at a first position and a second position of the variable weight system, wherein the sensor is optically coupled with the variable weight system and remote from the cable and the one or more pulleys.

2. The training system of claim 1, wherein a first end portion of the cable is coupled to the variable weight system and a second end portion of the cable is operably coupled to a harness.

3. The training system of claim 2, wherein at least a portion of the sensor is positioned above the variable weight system.

4. The training system of claim 1, wherein a first display of the one or more displays is configured to provide a first set of information while a second display of the one or more displays is configured to provide a second set of information.

5. The training system of claim 4, wherein the first set of information differs from the second set of information.

6. The training system of claim 1, further comprising:

an alignment device operably coupled with the housing, the alignment device configured to provide data to the computing system indicative of an orientation of the housing.

7. The training system of claim 1, further comprising:

a power generation assembly operably coupled with the training device and configured to power the timing device.

8. The training system of claim 1, wherein the timing device further comprises:

a transceiver configured to communicate with a remote electronic device.

9. The training system of claim 1, wherein the training device further comprises:

a reflective plate attached to a top portion of the variable weight system, wherein the sensor is optically coupled with the reflective plate during at least a portion of a timing sequence.

10. A method of operating a training system including a training device and a timing device, the training device including a frame having a base portion, one or more vertical supports, one or more brackets on an opposing side of the one or more vertical supports from the base portion, and a cable coupled to a weight system, wherein the one or more brackets support one or more pulleys operably coupled with the cable, the method comprising:

coupling the timing device to the frame with one or more fasteners, wherein the timing device is cantilevered from the frame when the fastener operably couples a housing of the timing device within a void of one or more brackets, and the one or more brackets positioned on an opposing side of the one or more vertical supports from the base portion, the timing device further positioned at least partially below one of the one or more pulleys and separated from a movement path of the weight system;

attaching the cable to a swimmer; and transmitting data from a sensor of the timing device to a computing system of the timing device related to one or more statistics based on an extension of the cable from the training device by the swimmer, wherein the sensor is positioned within the housing, stationary, and separated from the cable and the one or more pulleys.

11. The method of claim 10, further comprising:

displaying information related to the one or more statistics on a display operably coupled with a housing of the timing device.

12. The method of claim 10, further comprising:

transmitting the data from the sensor to a remote electronic device.

13. The method of claim 10, further comprising:

providing data related to the training device from a remote electronic device.

14. The method of claim 10, further comprising:

initiating a countdown on a display; and activating a sound from a speaker upon completion of the countdown, wherein the computing system calculates the one or more statistics based on data provided upon completion of the countdown.

15. A timing device for swimming, comprising:

a housing configured to operably couple with a training device, wherein the housing is configured to extend into a void of one or more brackets positioned on an opposing side of the one or more vertical supports from a base portion of the frame;

a sensor positioned within the housing and stationary relative to a frame and a variable weight system of the training device, the sensor configured to detect motion of the variable weight system at a first position and a second position as a swimmer moves the variable weight system, the sensor separated from a movement path of the weight system;

a computing system positioned within the housing and remote from the training device, the computing system operably coupled with the sensor and configured to calculate one or more statistics based on movement of a component within the training device; and a first display positioned within a first side portion of the housing and remote from the training device, the first display configured to extend at least partially on a laterally opposing side of the frame of the training device from the variable weight system, wherein the calculated statistic is provided on the first display of the timing device.

16. The timing device of claim 15, further comprising:

an alignment device operably coupled with the housing, the alignment device configured to provide data to the computing system indicative of an orientation of the housing.

17. The timing device of claim 16, further comprising:

a user interface operably coupled with the computing system and configured to alter one or more settings of the computing system.

18. The timing device of claim 15, wherein the component is a variable weight system and the computing system is configured to detect an amount of weight within the variable weight system based on a calculated power.

19. The training system of claim 1, further comprising: a computing system positioned within the housing and operably coupled with the sensor, the computing system configured to calculate a time between the first position and second position, wherein the calculated time is provided on one or more displays of the timing device.

* * * * *